US007866413B2

(12) United States Patent
Stauffer et al.

(10) Patent No.: US 7,866,413 B2
(45) Date of Patent: Jan. 11, 2011

(54) METHODS FOR DESIGNING AND FABRICATING EARTH-BORING ROTARY DRILL BITS HAVING PREDICTABLE WALK CHARACTERISTICS AND DRILL BITS CONFIGURED TO EXHIBIT PREDICTED WALK CHARACTERISTICS

(75) Inventors: Bruce Stauffer, The Woodlands, TX (US); William H. Heuser, Kuala Lumpur (MY); Jim L. Jacobsen, Erie, CO (US)

(73) Assignee: Baker Hughes Incorporated, Houston, TX (US)

( * ) Notice: Subject to any disclaimer, the term of this patent is extended or adjusted under 35 U.S.C. 154(b) by 615 days.

(21) Appl. No.: 11/404,389

(22) Filed: Apr. 14, 2006

(65) Prior Publication Data

US 2007/0240904 A1 Oct. 18, 2007

(51) Int. Cl.
*E21B 7/04* (2006.01)

(52) U.S. Cl. ..... 175/61; 175/40; 702/9

(58) Field of Classification Search ..... 175/45, 175/40, 61, 62, 73; 76/108.4; 702/9
See application file for complete search history.

(56) References Cited

U.S. PATENT DOCUMENTS

| | | | | |
|---|---|---|---|---|
| 4,303,994 | A * | 12/1981 | Tanguy | 367/35 |
| 4,508,182 | A | 4/1985 | Anders | |
| 4,662,458 | A * | 5/1987 | Ho | 175/27 |
| 4,739,841 | A * | 4/1988 | Das | 175/61 |
| 4,804,051 | A * | 2/1989 | Ho | 175/26 |
| 4,815,342 | A | 3/1989 | Brett et al. | |
| 4,903,245 | A * | 2/1990 | Close et al. | 340/853.3 |

(Continued)

FOREIGN PATENT DOCUMENTS

EP 1 006 256 A2 6/2000

(Continued)

OTHER PUBLICATIONS

Glowka, David A., "Use a Single-Cutter Data in the Analysis of PDC Bit Designs: Part 1- Development of a PDC Cutting Force Model," Aug. 1989, pp. 797-799 and 844-849.

(Continued)

*Primary Examiner*—Kenneth Thompson
(74) *Attorney, Agent, or Firm*—TraskBritt

(57) ABSTRACT

Walk characteristics of an earth-boring rotary drill bit may be predicted by measuring locations and orientations of cutting elements thereof and calculating the magnitude and direction of an imbalance force of the drill bit using the measurements obtained. The calculated imbalance force may be compared to the imbalance force of at least one other drill bit having a calculated imbalance force and observed walk characteristics. An earth-boring rotary drill bit may be designed by constructing a database including the magnitude and direction of a calculated imbalance force and observed walk characteristics for a number of drill bits. Desired walk characteristics are selected, the database is referenced, and the bit may be configured to exhibit an imbalance force selected to impart desired walk characteristics to the drill bit. Drill bits are configured to exhibit an imbalance force oriented in a predetermined direction relative to a blade of the drill bit. A system may be employed to monitor the imbalance force of an operating drill bit and to provide or implement desirable operational parameters to compensate for same.

27 Claims, 12 Drawing Sheets

U.S. PATENT DOCUMENTS

| | | | | | |
|---|---|---|---|---|---|
| 5,010,789 | A | | 4/1991 | Brett et al. | |
| 5,042,596 | A | * | 8/1991 | Brett et al. | 175/57 |
| 5,099,929 | A | | 3/1992 | Keith et al. | |
| 5,099,934 | A | | 3/1992 | Barr | |
| 5,109,935 | A | | 5/1992 | Hawke | |
| 5,119,892 | A | | 6/1992 | Clegg et al. | |
| 5,165,494 | A | | 11/1992 | Barr | |
| 5,178,222 | A | | 1/1993 | Jones et al. | |
| 5,186,268 | A | | 2/1993 | Clegg | |
| 5,358,059 | A | * | 10/1994 | Ho | 175/45 |
| 5,456,141 | A | | 10/1995 | Ho | |
| 5,608,162 | A | | 3/1997 | Ho | |
| 5,842,149 | A | * | 11/1998 | Harrell et al. | 702/9 |
| 5,937,958 | A | | 8/1999 | Mensa-Wilmot et al. | |
| 5,957,223 | A | | 9/1999 | Doster et al. | |
| 5,967,247 | A | | 10/1999 | Pessier | |
| 6,006,845 | A | | 12/1999 | Illerhaus et al. | |
| 6,123,161 | A | | 9/2000 | Taylor | |
| 6,164,390 | A | | 12/2000 | Murdock et al. | |
| 6,173,797 | B1 | | 1/2001 | Dykstra et al. | |
| 6,186,251 | B1 | | 2/2001 | Butcher | |
| 6,308,790 | B1 | | 10/2001 | Mensa-Wilmot et al. | |
| 6,438,495 | B1 | * | 8/2002 | Chau et al. | 702/9 |
| 6,785,641 | B1 | * | 8/2004 | Huang | 703/7 |
| 7,020,597 | B2 | * | 3/2006 | Oliver et al. | 703/7 |
| 7,261,167 | B2 | * | 8/2007 | Goldman et al. | 175/39 |
| 2003/0136588 | A1 | * | 7/2003 | Truax et al. | 175/376 |
| 2005/0096847 | A1 | * | 5/2005 | Huang | 702/9 |
| 2006/0167669 | A1 | * | 7/2006 | Cariveau et al. | 703/7 |
| 2007/0029111 | A1 | * | 2/2007 | Chen | 175/24 |

FOREIGN PATENT DOCUMENTS

| | | | | |
|---|---|---|---|---|
| EP | 1 146 200 | A1 | | 10/2001 |
| GB | 2 323 868 | A | | 10/1998 |
| GB | 2346628 | A | * | 8/2000 |
| GB | 2 384 567 | A | | 7/2003 |
| GB | 2 400 696 | A | | 10/2004 |
| WO | 95/13152 | | | 5/1995 |

OTHER PUBLICATIONS

Glowka, D.A., "Use of Single-Cutter Data in the Analysis of PDC Bit Designs: Part 2- Development and Use of the PDCWEAR Computer Code," 1989, 10 pages.

Menand et al., "How the Bit Profile and Gages Affect the Well Trajectory," Feb. 2002, IADC/SPE Drilling Conference, Dallas, TX, pp. 1-13.

Ho, H-S., "Prediction of Drilling Trajectory in Directional Wells Via a New Rock-Bit Interaction Model," Society of Petroleum Engineers, Sep. 1987, pp. 83-95.

U.S. Appl. No. 11/146,934, filed Jun. 7, 2005 by Pastusek et al., entitled, "Method and Apparatus for Collecting Drill Bit Performance Data."

PCT International Search Report, for PCT/US2007/009060, dated Aug. 29, 2007 (4 pages).

PCT Written Opinion, for PCT/US2007/009060, dated Aug. 29, 2007 (6 pages).

* cited by examiner

METHODS FOR DESIGNING AND FABRICATING EARTH-BORING ROTARY DRILL BITS HAVING PREDICTABLE WALK CHARACTERISTICS AND DRILL BITS CONFIGURED TO EXHIBIT PREDICTED WALK CHARACTERISTICS

BACKGROUND OF THE INVENTION

1. Field of the Invention

The present invention generally relates to earth-boring drill bits and other tools for drilling subterranean formations, and to methods of designing and fabricating such earth-boring drill bits. More particularly, the present invention relates to earth-boring drill bits and other tools for drilling subterranean formations that exhibit predictable walk characteristics, as well as to methods for designing and fabricating the same. Furthermore, the present invention relates to systems and methods for collecting data relating to imbalance forces and walk characteristics of earth-boring drill bits and other tools for drilling subterranean formations.

2. State of the Art

Rotary drill bits are commonly used for drilling bore holes or well bores in earth formations. One type of rotary drill bit is the fixed-cutter bit (often referred to as a "drag" bit), which typically includes a plurality of cutting elements secured to a face region of a bit body. Generally, the cutting elements of a fixed-cutter type drill bit have either a disk shape or a substantially cylindrical shape. A cutting surface comprising a hard, superabrasive material, such as mutually bound particles of diamond, may be provided on a substantially circular end surface of each cutting element. Such cutting elements are often referred to as "polycrystalline diamond compact" (PDC) cutters. Typically, the cutting elements are fabricated separately from the bit body and secured within pockets formed in the outer surface of the bit body. A bonding material such as an adhesive or, more typically, a braze alloy may be used to secure the cutting elements to the bit body. The fixed-cutter drill bit may be placed in a bore hole such that the cutting elements are adjacent the earth formation to be drilled. As the drill bit is rotated, the cutting elements scrape across and shear away the surface of the underlying formation.

The bit body of a rotary drill bit typically is secured to a hardened steel shank having an American Petroleum Institute (API) thread connection for attaching the drill bit to a drill string. The drill string includes tubular pipe and equipment segments coupled end to end between the drill bit and other drilling equipment at the surface. Equipment such as a rotary table or top drive may be used for rotating the drill string and the drill bit within the bore hole. Alternatively, the shank of the drill bit may be coupled directly to the drive shaft of a down-hole motor, which then may be used to rotate the drill bit.

The bit body of a rotary drill bit may be formed from steel. Alternatively, the bit body may be formed from a particle-matrix composite material. Such bit bodies typically are formed by embedding a steel blank in a carbide particulate material volume, such as particles of tungsten carbide (WC), and infiltrating the particulate carbide material with a liquified metal material (often referred to as a "binder" material), such as a copper alloy, to provide a bit body substantially formed from a particle-matrix composite material. Drill bits that have a bit body formed from such a particle-matrix composite material may exhibit increased erosion and wear resistance relative to drill bits having steel bit bodies.

The process of drilling a subterranean formation is often a three-dimensional process, as the drill bit not only penetrates the formation linearly along a vertical axis, but is either purposefully or unintentionally drilled along a curved path or at an angle relative to a theoretical vertical axis extending into the subterranean formation in a direction substantially parallel to the gravitational field of the earth. The term "directional drilling," as used herein, means both the process of directing a drill bit along some desired trajectory through a subterranean formation to a predetermined target location to form a bore hole, and the process of directing a drill bit along a predefined trajectory in a direction other than directly downwards into a subterranean formation in a direction substantially parallel to the gravitational field of the earth to either a known or unknown target. Referring to FIG. 1, the orientation of a drill bit and/or a well bore hole may be described in terms of an "inclination angle" and a "direction angle" using a theoretical vertical axis 2 extending into the ground and oriented parallel to the gravitational field of the earth, and a horizontal plane 4 oriented substantially perpendicular to the theoretical vertical axis 2. The inclination angle may be defined as the shortest angle between the longitudinal axis 6 extending through the bit and/or the well bore hole and the theoretical vertical axis 2. The direction angle may be defined as the angle extending in the horizontal plane 4 from a reference direction, such as North, in the clockwise direction to the projection 8 of the longitudinal axis 6 extending through the bit and/or the well bore hole onto the horizontal plane 4. The direction angle is often referred to in the art as the "azimuth" or the "azimuthal angle."

As an example, when a well bore hole extends substantially vertically downward into the subterranean formation, the inclination angle is zero and there is no direction angle. Furthermore, when a well bore hole extends substantially horizontally in a lateral direction within a subterranean formation, the inclination angle is about ninety degrees, and the direction angle may be any angle between zero and three hundred sixty degrees.

Several approaches have been developed for directional drilling. For example, it is known to use a bottom hole assembly (BHA) that includes a motor driven by a flow of drilling fluid, or "mud" pumped down the drill string to the motor for rotating the drill bit as mounted to a bent sub or a bent housing for orienting the drill bit at an angle with respect to the bore hole. Other approaches involve, for example, the use of a "whipstock," which may include a wedge-shaped tool positioned at the bottom of the well bore hole and oriented to deflect the drill bit at an angle with respect to the longitudinal axis of the bore hole and drill through a side wall thereof. Yet another method for directional drilling involves the use of a "jetting bit," which may include at least one drilling fluid nozzle configured to orient a jet of fluid emitted thereby in a predetermined direction relative to the bit face. The drill bit may be positioned at the bottom of the bore hole in a desired orientation, and the jet of fluid emitted from the nozzle is used to erode a pocket out of the formation material surrounding the bore hole while the drill bit is not rotating. The drill bit may then be advanced into the eroded pocket, and rotation of the drill bit is resumed, the drill bit advancing at an angle relative to the prior trajectory.

After a target within a subterranean formation has been identified, a trajectory for a drill bit and the well bore hole produced thereby may be predefined. The term "deviation control," as used herein, means the process of maintaining the drill bit, and thus the well bore hole, within predetermined limits relative to a predefined trajectory.

The processes of directional drilling and deviation control are complicated by the complex interaction of forces between the drill bit and the walls of the subterranean formation lining the well bore hole.

In drilling with rotary drill bits and, particularly with fixed-cutter type rotary drill bits, it is known that if a lateral force (often referred to as a side force or a radial force) is applied to the drill bit, the drill bit may "walk" or "drift" from the straight path that is parallel to the intended longitudinal axis of the well bore hole. When a drill bit walks in such a way that the direction angle increases (increasing azimuth), the drill bit may be said to walk to the right or to exhibit "right walk." Similarly, when a drill bit walks in such a way that the direction angle decreases (decreasing azimuth), the drill bit may be said to walk to the left or to exhibit "left walk." When a drill bit does not walk or drift away from the straight path that is parallel to the longitudinal axis of the well bore hole at the bottom thereof, the bit may be referred to as an "anti-walk" drill bit and may be said to exhibit "neutral walk."

In a similar manner, when a drill bit drifts in a direction such that the inclination angle increases, the drill bit is said to exhibit a tendency to "build," and when a drill bit drifts in a direction such that the inclination angle decreases, the drill bit is said to exhibit a tendency to "drop." Drill bits may, however, exhibit a tendency to walk to the right or to the left more often than they exhibit a tendency to build or drop.

Many factors or variables may at least partially contribute to the reactive forces and torques applied to a drill bit by the surrounding subterranean formation. Such factors and variables may include, for example, the "weight on bit" (WOB), the rotational speed of the bit, the physical properties and characteristics of the subterranean formation being drilled, the hydrodynamics of the drilling fluid, the length and configuration of the bottom hole assembly (BHA) to which the bit is mounted, and various design factors of the drill bit including the cutting element size, radial placement, back (or forward) rake, side rake, etc. Various complex modeling and computational methods known in the art may be used to calculate the forces and torques acting on a drill bit under predetermined conditions and parameters.

In view of the above, it has been suggested in the art to design fixed-cutter type rotary drill bits that exhibit predetermined walk characteristics (i.e., left walk, right walk, or neutral walk) using these complex modeling and computational methods. For example, a drill bit design may be created using three-dimensional modeling software. The design variables (together with other variables relating to the anticipated drilling conditions such as those listed above) may then be used by computational software to estimate by mathematical calculations the reactive forces and torques applied to the drill bit by the surrounding subterranean formation during drilling, and these forces and torques may be used to estimate the trajectory of the drill bit through the subterranean formation.

Such efforts have been met with limited success. This may be due, at least in part, to the inability to fabricate drill bits according to the exact dimensions specified in the drill bit design. For example, the cutting elements of a fixed-cutter type rotary drag bit are often hand-brazed into cutter pockets on the face of the drill bit, and even slight variations in cutter position (back rake angle, side rake angle, etc.) may cause a drill bit to exhibit unexpected walk behavior. For example, a drill bit design may be created and configured to exhibit predetermined walk characteristics. Several drill bits may be fabricated according to the single drill bit design within manufacturing tolerances. In the field, however, some of these drill bits may exhibit left hand walk, others may exhibit right hand walk, and still others may exhibit neutral walk.

In view of the above, there is a need in the art for methods for designing and fabricating rotary drill bits for drilling subterranean earth formations that exhibit predictable walk characteristics.

BRIEF SUMMARY OF THE INVENTION

In one aspect, the present invention includes a method of predicting the walk characteristics of an earth-boring rotary drill bit. Longitudinal and lateral (radial) location, orientation (including side and back rakes) of at least some cutting elements (also termed "cutters") on an earth-boring rotary drill bit may be measured, and the magnitude and direction of an imbalance force of the drill bit may be calculated using at least some of the measurements obtained. The magnitude and direction of the calculated imbalance force may be compared to the magnitude and direction of an imbalance force of at least one other drill bit having a calculated imbalance force and known walk characteristics to predict the walk characteristics of the drill bit.

In another aspect, the present invention includes a method of designing an earth-boring rotary drill bit exhibiting predicted walk characteristics. The method includes constructing a database including the magnitude and direction of a calculated imbalance force and observed walk characteristics of each of a plurality of actual drill bits. Desired walk characteristics to be exhibited by a drill bit to be fabricated may be selected, and the database may be referenced. The drill bit may be fabricated and configured to exhibit an imbalance force having a predetermined magnitude and direction selected to impart desired walk characteristics to the drill bit.

In yet another aspect, the present invention includes a method of fabricating an earth-boring rotary drill bit having predicted walk characteristics. A drill bit is provided that has a bit body that includes a plurality of longitudinally extending blades defining junk slots therebetween, and the drill bit is configured to exhibit an imbalance force oriented in a predetermined direction relative to a blade of the drill bit.

In an additional aspect, the present invention includes an earth-boring rotary drill bit having a bit body that includes a plurality of longitudinally extending blades defining junk slots therebetween. Each blade of the plurality of blades has a plurality of cutting elements mounted thereon. The drill bit is configured to exhibit an imbalance force oriented in a predetermined direction relative to a blade of the plurality of blades. For example, the drill bit may be configured to exhibit an imbalance force oriented towards a blade of the drill bit to impart neutral walk characteristics to the drill bit. As another example, the drill bit may be configured to exhibit an imbalance force oriented towards a junk slot between two blades of the drill bit to impart left walk characteristics to the drill bit.

In still another aspect, the present invention includes a system for collecting data relating to an imbalance force of a rotary drill bit for drilling at least one subterranean formation. The system includes a drilling tool and an electronic device attached to the drilling tool. The electronic device includes at least one electronic signal processor, at least one memory device in electrical communication with the at least one electronic signal processor, and at least one input device in electrical communication with the at least one electronic signal processor. The electronic device may be configured to calculate an imbalance force of a rotary drill bit for drilling at least one subterranean formation and to record the calculated imbalance force in the at least one memory device.

The features, advantages, and alternative aspects of the present invention will be apparent to those skilled in the art from a consideration of the following detailed description considered in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

DETAILED DESCRIPTION OF THE INVENTION

The illustrations presented herein are not meant to be actual views of any particular material, apparatus, system, or method, but are merely idealized representations that are employed to describe the present invention. Additionally, elements common between figures may retain the same numerical designation.

Figure 2:
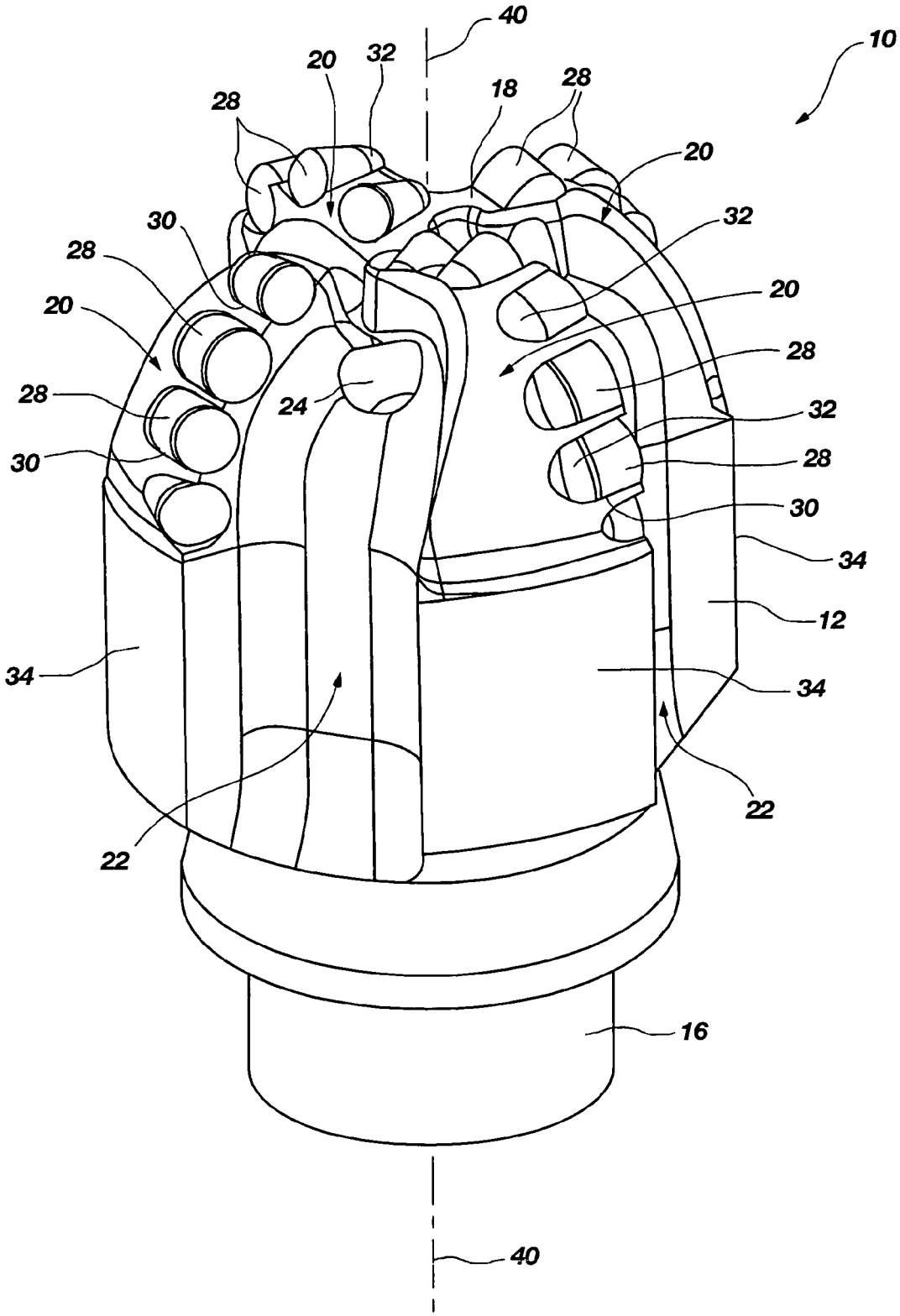
FIG. 2 is a side view of an earth-boring rotary drill bit.

A fixed-cutter rotary drill bit 10 is illustrated in FIG. 2. As seen therein, the drill bit 10 may include a bit body 12, which may be secured to a steel shank 16. The steel shank 16 may include an API threaded connection portion (not shown) for attaching the drill bit 10 to a drill string (not shown). The bit body 12 may comprise a particle-matrix composite material. The particle-matrix composite material may include a plurality of hard particles dispersed randomly throughout a matrix material.

The hard particles may comprise diamond or ceramic materials such as carbides, nitrides, oxides, and borides (including boron carbide ($B_4C$)). More specifically, the hard particles may comprise carbides and borides made from elements such as W, Ti, Mo, Nb, V, Hf, Ta, Cr, Zr, Al, and Si. By way of example and not limitation, materials that may be used to form hard particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminum oxide ($Al_2O_3$), aluminum nitride (AlN), boron nitride (BN), and silicon carbide (SiC). Furthermore, combinations of different hard particles may be used to tailor the physical properties and characteristics of the particle-matrix composite material.

The matrix material of the particle-matrix composite material may include, for example, cobalt-based, iron-based, nickel-based, iron and nickel-based, cobalt and nickel-based, iron and cobalt-based, aluminum-based, copper-based, magnesium-based, and titanium-based alloys. The matrix material may also be selected from commercially pure elements such as cobalt, aluminum, copper, magnesium, titanium, iron, and nickel.

As known in the art, the bit body 12 may be fabricated by, for example, forming a refractory mold having an interior void substantially defining a desired shape of the bit body 12, filling the interior void with the hard particles, and infiltrating the hard particles with molten matrix material.

In additional embodiments, the bit body 12 may substantially comprise a metal or metal alloy such as, for example, steel, and may be formed from a block of such material by machining the block using conventional machining processes (e.g., milling, turning, drilling, etc.).

Regardless of the material from which the bit body 12 is fabricated, the bit body 12 may include wings or blades 20, with junk slots 22 located between adjacent blades 20. Nozzles 24 may be provided in a face 18 of the drill bit 10 and configured to communicate drilling fluid to the face 18 of the drill bit 10 from an internal longitudinal bore or plenum (not shown), which may extend through the steel shank 16 and partially through the bit body 12. Internal fluid passageways (not shown) may extend between the face 18 of the bit body 12 and the internal longitudinal bore or plenum, and the nozzles 24 may be configured as removable and replaceable inserts positioned within mouths of the internal fluid passageways opening onto the face 18.

A plurality of cutters 28 may be provided on the face 18 of the bit body 12. The cutters 28 may be provided along the blades 20 within pockets 30 formed in the face 18 of the bit body 12, and may be supported from behind by buttresses 32, which may be integrally formed with the bit body 12. At least one gage pad 34 may be provided on each blade 20, as known in the art. By way of example and not limitation, the cutters 28 may be, or include, PDC cutters.

During drilling operations, the drill bit 10 may be positioned at the bottom of a well bore hole and rotated while drilling fluid is pumped down the drill string from which drill bit 10 is suspended to the face 18 of the bit body 12 through the nozzles 24. As the PDC cutters 28 shear or scrape away the underlying earth formation, the formation cuttings mix with and are suspended within the drilling fluid, pass upwardly through the junk slots 22 into an annular space between the bore hole wall and the drill string exterior, and may be communicated through the annular space to the surface of the subterranean formation.

After fabricating a drill bit, such as the drill bit 10 shown in FIG. 2, it is possible to calculate with some accuracy the reactive forces acting on each cutter 28 engaging a subterranean formation of known physical properties for a particular rate of penetration (ROP) and rate of rotation of the drill bit 10. These reactive forces may be resolved into tri-axial components, two of which, the tangential force (often referred to as a "cutting force" or a "circumferential force") and the radial force (often referred to as a "penetrating force" or a "normal force"), contribute to the overall lateral forces acting on the drill bit 10. The sum of the tangential forces and the radial forces acting on each of the cutters 28 on the face 18 of the drill bit 10 defines the magnitude and direction of a net side or lateral force acting on the drill bit 10 in a plane perpendicular to the longitudinal axis 40 of the drill bit 10 due to the reactive forces acting on the cutters 28 by the formation. This net side force is referred to herein as the imbalance force of the drill bit 10, and may be expressed as a percentage of the weight on bit (WOB). A fairly detailed explanation of one representative manner in which the individual reactive forces acting on individual cutters 28 of a drill bit 10 may be calculated and summed to determine the imbalance force of a drill bit 10 is described in U.S. Pat. No. 4,815,342 to Brett et al., the disclosure of which is hereby incorporated herein in its entirety by this reference.

As previously discussed herein, it may be difficult to fabricate drill bits, such as the drill bit 10 shown in FIG. 2, according to the exact dimensions specified for a particular drill bit design. For example, the cutters 28 of the drill bit 10 may be hand brazed into the cutter pockets 30 on the face 18 of the drill bit 10, and even variations as slight as 10 in back rake angle or side rake angle may change at least one of the magnitude and the direction of the imbalance force of the drill bit 10. As a result, it is highly desirable to obtain precise measurements of the size, location, and orientation of each cutter 28 directly from a drill bit 10 after the drill bit 10 has been fabricated to accurately determine the magnitude and direction of the imbalance force of the drill bit 10. By way of example and not limitation, such precise measurements may be obtained using a coordinate measuring machine (CMM). As used herein, the term "coordinate measuring machine" means any machine capable of identifying the location of a point on a surface of a three-dimensional object in a predefined three-dimensional space. Coordinate measuring machines may utilize, for example, touch probes, electromagnetic radiation (e.g., lasers, optical probes, etc.), or ultrasonic vibrations to identify the location of a point on a surface of a three-dimensional object in a predefined three-dimensional space.

The details of such a commercially available coordinate measuring machine and a particular manner in which such a coordinate measuring machine may be used to construct a computer model of the drill bit 10 are described in the previously incorporated U.S. Pat. No. 4,815,342 to Brett et al., and need not be described in detail herein. Such coordinate measuring machines are commercially available from, for example, Sheffield Measurement, Inc. of Fond du Lac, Wis.

Figure 3:
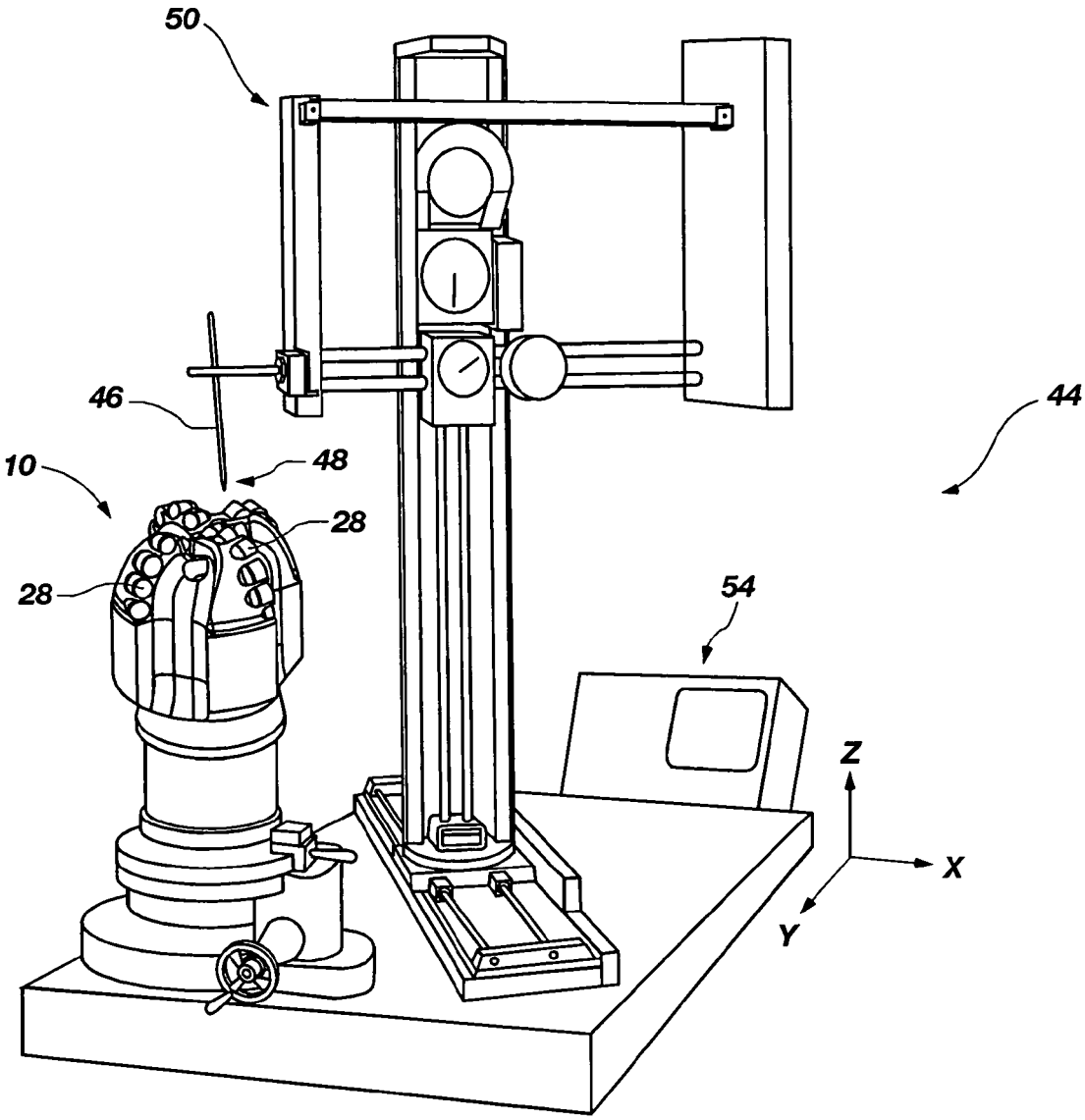
FIG. 3 is a perspective view of a coordinate measuring machine being used to obtain measurements from a drill bit such as that shown in FIG. 2.

Briefly, a commercially available touch probe type coordinate measuring machine 44 is shown in FIG. 3 that may be used to obtain measurements directly from the drill bit 10. The coordinate measuring machine 44 may include a pointer 46 that is attached to a moveable frame assembly 50. A point 48 is provided on an end of the pointer 46. The coordinate measuring machine 44 may include meters or sensors for identifying and recording the precise position of the point 48 on the end of the pointer 46 relative to a predefined origin in a three-dimensional coordinate system defined by X, Y, and Z axes. A computer device 54 may be used to provide a read-out of the X, Y and Z coordinates of the point 48 on the pointer 46. The computer device 54 may also be used to record the X, Y and Z coordinates in memory of the computer device 54, in memory of a remote server or computer, or in a removable recordable medium such as a compact disk, floppy drive, external hard drive, etc. The pointer 46 may be positioned or tapped on a plurality of points on the surface of the drill bit 10, and in particular on a plurality of points on and around each of the cutters 28 of the drill bit 10, and the X, Y, and Z coordinates of each particular point may be identified and recorded. From this data, the size, location, and orientation of at least some of the cutters 28 may be determined, and a computer model of the drill bit 10 may be constructed.

Using techniques such as those described above, novel methods for predicting the walk characteristics of an earth-boring rotary drill bit, methods for designing and fabricating an earth-boring rotary drill bit, and novel earth-boring rotary drill bits may be provided, as described in further detail below.

A plurality of substantially similar earth-boring rotary drill bits may be fabricated or otherwise provided. By way of example and not limitation, each drill bit may be substantially similar to the previously described earth-boring rotary drill bit 10 shown in FIG. 2. Each of the plurality of drill bits 10 may be provided or fabricated according to a single size and design specification.

After providing each of the plurality of drill bits 10, measurements regarding the geometry of each drill bit 10, and in particular the size, location, and orientation of at least some of the cutters 28 on the face 18 of each drill bit 10, may be obtained directly from each drill bit 10 using a coordinate measuring machine 44 as previously described herein, and a computer model of each drill bit 10 may be constructed.

Each of the plurality of drill bits 10 may then be used to drill a bore hole through a subterranean earth formation (or through a test formation in a lab). During the drilling process, the hardness and/or compressive strength of the subterranean formation (which may be known beforehand or determined during or after drilling), the rate of penetration (ROP), the weight on bit (WOB) applied and the rate of rotation of each drill bit 10 may be recorded together with corresponding observed walk characteristics or behavior of the particular drill bit 10 used during each drilling process. The walk characteristics may include, for example, whether the drill bit 10 exhibits left walk or right walk, and the rate at which the drill bit walks to the right or to the left. For example, the rate at which the drill bit 10 walks to the right or to the left may be expressed as the change in the direction angle per unit depth of drilling into the formation, which may be expressed in units of degrees per one hundred feet. In other words, if the direction angle changes from about 60° to about 58° (i.e., a change of 2°) after drilling about one hundred feet through a formation with a particular drill bit 10, the drill bit 10 may be said to exhibit left walk at a rate of about 2.0 degrees per one hundred feet under the particular drilling parameters used.

By way of example and not limitation, data relating to, for example, the hardness and/or compressive strength of the subterranean formation, the rate of penetration (ROP), the weight on bit (WOB) applied, the rate of rotation of the drill bit 10, and the walk characteristics or behavior of the particular drill bit 10 used during each drilling process, may be collected and recorded manually by personnel while drilling a well bore hole using the drill bit 10. In addition or as an alternative, such data may be collected and recorded automatically using accelerometers, magnetometers, as well as other sensors disposed within the drill string, the drill bit 10, or both, together with associated electronic devices and equipment (i.e., processors, memory, power supplies, etc.). Methods and related apparatuses that may be used to collect such data using accelerometers, magnetometers, and/or other sensors disposed within the drill string and/or the drill bit 10 during a drilling process are described in U.S. patent application Ser. No. 11/146,934, filed Jun. 7, 2005, entitled "Method and Apparatus for Collecting Drill Bit Performance Data" and assigned to the assignee of the present application, the disclosure of which patent application is hereby incorporated herein in its entirety by this reference.

The data collected during each drilling process regarding the variables or parameters affecting the imbalance force of a drill bit 10 (e.g., hardness and/or compressive strength of the subterranean formation, the rate of penetration, the weight on bit, the rate of rotation of the drill bit, etc.) may be recorded in a database, together with the observed walk characteristics of the drill bit. As used herein, the term "database" means any collection of data recorded in a tangible medium and includes, for example, electronic databases, as well as both electronic and handwritten spreadsheets, catalogues, lists, etc.

The measurements previously obtained directly from each of the drill bits 10 using the coordinate measuring machine 44, and the recorded information obtained in association with each drilling operation regarding the variables or parameters affecting the imbalance force of the drill bit 10, may then be used to calculate the magnitude and direction of the imbalance force acting on each of the drill bits 10 during the drilling operations using methods such as those described in detail in U.S. Pat. No. 4,815,342 to Brett et al. The calculated magnitude and direction of the imbalance forces may be recorded in the database and correlated to the observed walk characteristics for each respective drill bit 10.

After such a database has been created and includes the calculated magnitude and direction of imbalance forces and observed walk characteristics for each of a plurality of drill bits 10 in conjunction with drilling parameters associated with their use in drilling (e.g., formation properties, rate of penetration, weight on bit, rate of rotation of the drill bit, etc.), the database may be referenced and used to predict the walk characteristics of other earth-boring rotary drill bits 10 that are similar in design to those used to construct the database.

For example, a drill bit 10 having unknown walk characteristics may be fabricated or otherwise provided. The drill bit 10 may be measured and modeled in substantially the same manner as each of the drill bits 10 used to construct the database. By way of example and not limitation, the drill bit 10 may be measured and modeled at least in part by measuring the size, location, and orientation of each of the cutters 28 on the face 18 of the drill bit 10 using a coordinate measuring machine 44, as previously described herein in relation to FIG. 2. Once the drill bit 10 has been measured and modeled, the imbalance force of the drill bit 10 may be calculated for a predefined set of drilling parameters under which it is anticipated to drill a well bore hole using the drill bit 10. The magnitude and direction of the calculated imbalance force may be compared to the imbalance forces in the database for the particular drilling parameters, and the previously observed walk characteristics recorded in the database may be used to predict the walk characteristics of the drill bit 10 having unknown walk characteristics.

After the walk characteristics have been predicted for a particular drill bit 10, a drill bit trajectory through a subterranean formation to be drilled to a predetermined target region may be calculated using the predicted walk characteristics. Methods for calculating a drill bit trajectory through a subterranean formation to a predetermined target are known to those of ordinary skill in the art.

By way of example and not limitation, the database may comprise an electronic database, and a computer system (not shown) such as, for example, a commercially available desktop or laptop computer may be configured under control of a computer program to perform an algorithm configured to electronically reference the electronic database and compare the magnitude and direction of the calculated imbalance force of the drill bit 10 having unknown walk characteristics to the magnitude and direction of the calculated imbalance forces for each of the drill bits 10 having observed, known walk characteristics that were used to construct the database.

A database correlating calculated imbalance forces to observed walk characteristics for a plurality of drill bits 10 may also be used to design and fabricate earth-boring rotary drill bits 10 that exhibit predicted walk characteristics. By way of example and not limitation, desired walk characteristics to be exhibited by a drill bit 10 to be fabricated may be selected. The database may be referenced to identify drill bits 10 that have been observed to exhibit the desired walk characteristics, and the calculated magnitude and direction of the imbalance force of the drill bit 10 that was observed to exhibit the desired walk characteristics may be identified from the database. The drill bit 10 may then be fabricated and configured to exhibit an imbalance force having a predetermined magnitude and direction that have been selected to impart the desired walk characteristics to the drill bit 10.

Figure 1:
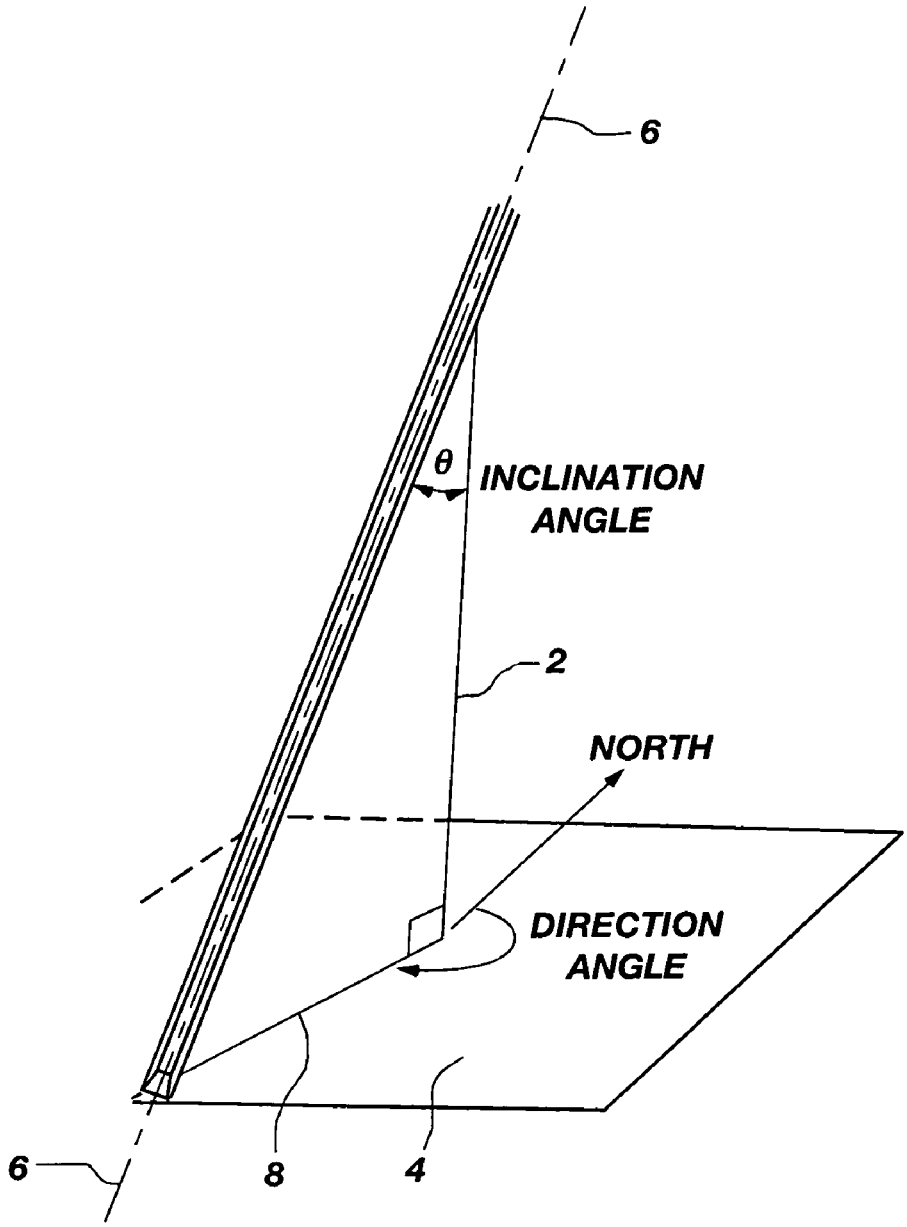
FIG. 1 illustrates a direction angle and an inclination angle of a well bore hole extending through a subterranean formation.
Figure 4:
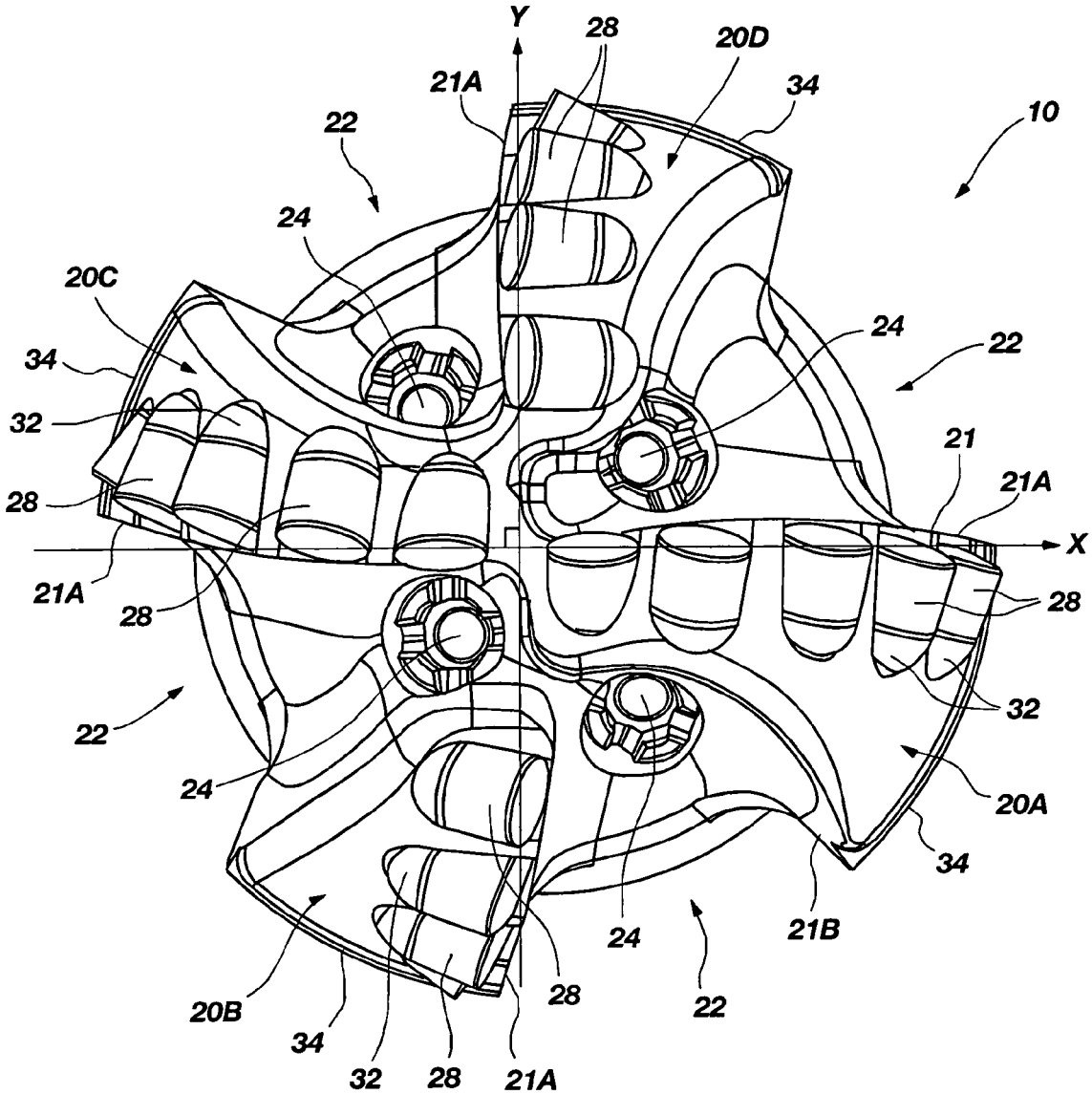
FIG. 4 is an end view of the drill bit shown in FIG. 2.

The direction and magnitude of a calculated imbalance force of a drill bit, such as the drill bit 10 shown in FIG. 1, may be represented by placing an imbalance force vector over an end view of the face of the drill bit. FIG. 4 is an end view illustrating the face of the drill bit 10 shown in FIG. 2. Each of the cutters 28 have been labeled with a number between 1 and 19 indicating the relative radial position of each individual cutter 28 with respect to the longitudinal axis 40 (FIG. 2) of the drill bit 10, the cutter 28 labeled "1" being radially closest to the longitudinal axis 40 and the cutter labeled "19" being radially farthest from the longitudinal axis 40. As also seen in FIG. 4, the drill bit 10 may include a first blade 20A, a second blade 20B, a third blade 20C, and a fourth blade 20D. The blade 20A on which the cutter 28 labeled "1" is mounted may be referred to as the "number one blade."

The magnitude and direction of a calculated imbalance force with respect to the drill bit 10 may be described by, for example, defining a Cartesian coordinate system over an end view of the drill bit 10, as shown in FIG. 4. By way of example and not limitation, an XY plane may be defined such that the intersection between the X axis and the Y axis is located at the center of the drill bit 10 and oriented such that the X axis extends in a direction generally along the leading edge 21A of the number one blade 20A. Any force acting at least partially in a radial direction on the drill bit 10 can then be broken into a first component acting on the drill bit 10 in a direction parallel to the X axis and a second component acting on the drill bit 10 in a direction parallel to the Y axis. The X component and the Y component may be summed to determine the total force acting on the drill bit 10. The direction of the total force vector may be characterized using, for example, the angle extending from the positive X axis in the counterclockwise direction to the total force vector. In this manner, the direction of any force acting at least partially in a radial direction on the drill bit 10 may be characterized as having a direction between 0° and 360°.

Figure 5A:
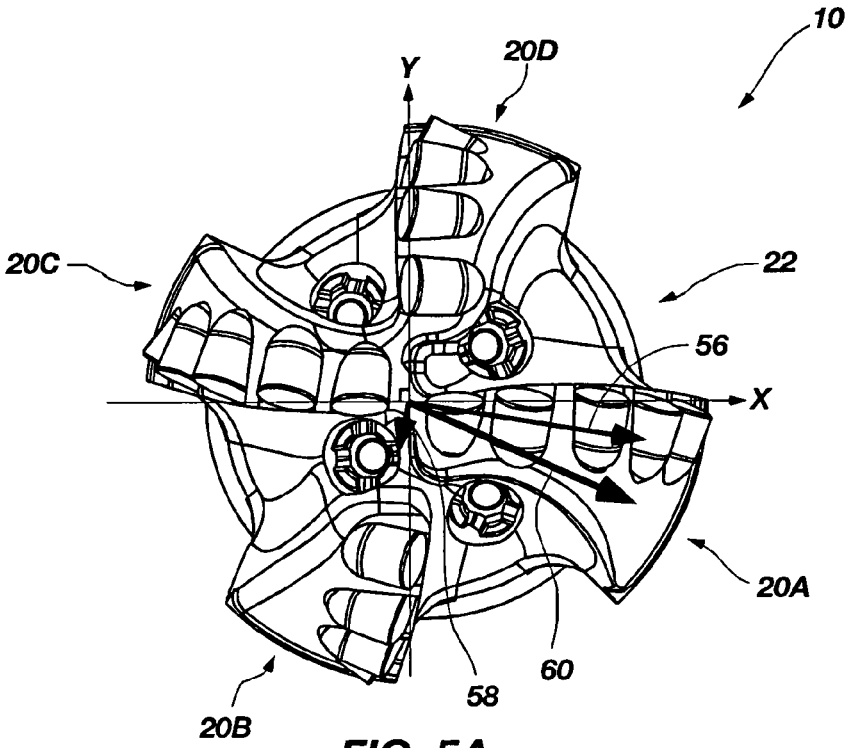
FIG. 5A is an end view like that shown in FIG. 4 illustrating an imbalance force vector pointing towards a blade of the drill bit shown in FIG. 2.
Figure 5B:
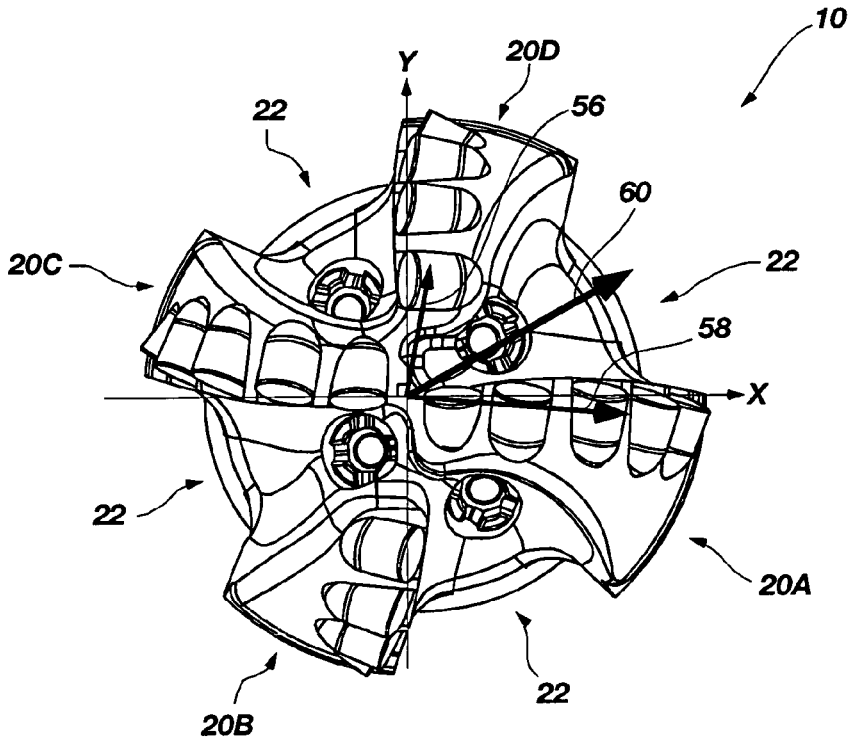
FIG. 5B is an end view like that shown in FIG. 4 illustrating an imbalance force vector pointing towards a junk slot of the drill bit shown in FIG. 2.

FIG. 5A is an end view of the drill bit 10 shown in FIG. 2. Using the previously described techniques, the radial force and the tangential force acting on each cutter 28 of the drill bit 10 may be calculated for a given set of operating variables, as previously described. The radial force acting on each of the cutters 28 may be summed to provide a total radial force vector 56 shown in FIG. 5A, which may be characterized in terms of an X component and a Y component (not shown). Similarly, the tangential force acting on each of the cutters 28 may be summed to provide a total tangential force vector 58 shown in FIG. 5A, which also may be characterized in terms of an X component and a Y component (not shown). The sum of the total radial force vector 56 and the total tangential force vector 58 may define the total imbalance force vector 60, which also may be characterized in terms of an X component and a Y component (not shown). The total imbalance force vector 60 may be positioned to extend from the center of the drill bit 10 in a radially outward direction, as shown in FIG. 5A. As seen therein, the imbalance force vector 60 points in a direction substantially towards the center of the number one blade 20A, and has a direction of about 330°. As seen in FIG. 5B, the imbalance force vector 60 may point in a direction towards the junk slot 22 between the number one blade 20A and the blade 20D, and may have a direction of about 45°.

Figure 6A:
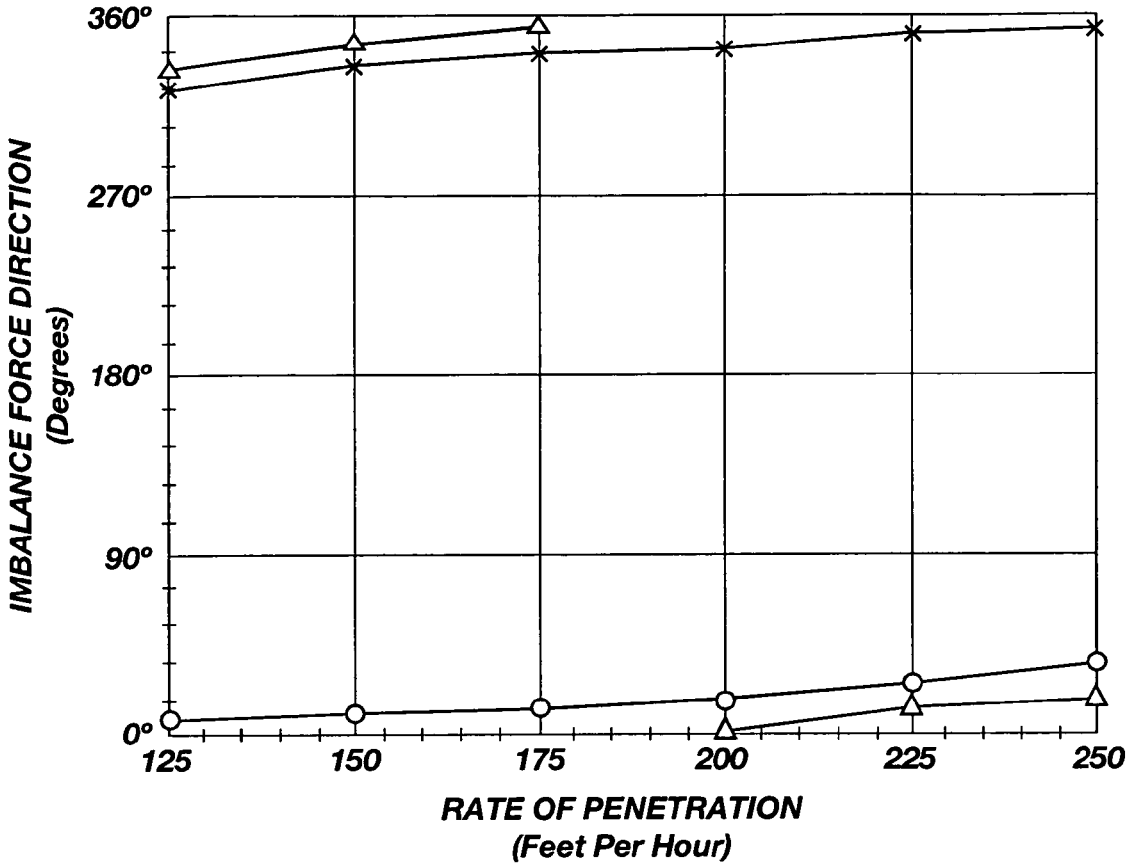
FIG. 6A is a graph of the calculated imbalance force direction for three different drill bits over a range of rates of penetration.
Figure 6B:
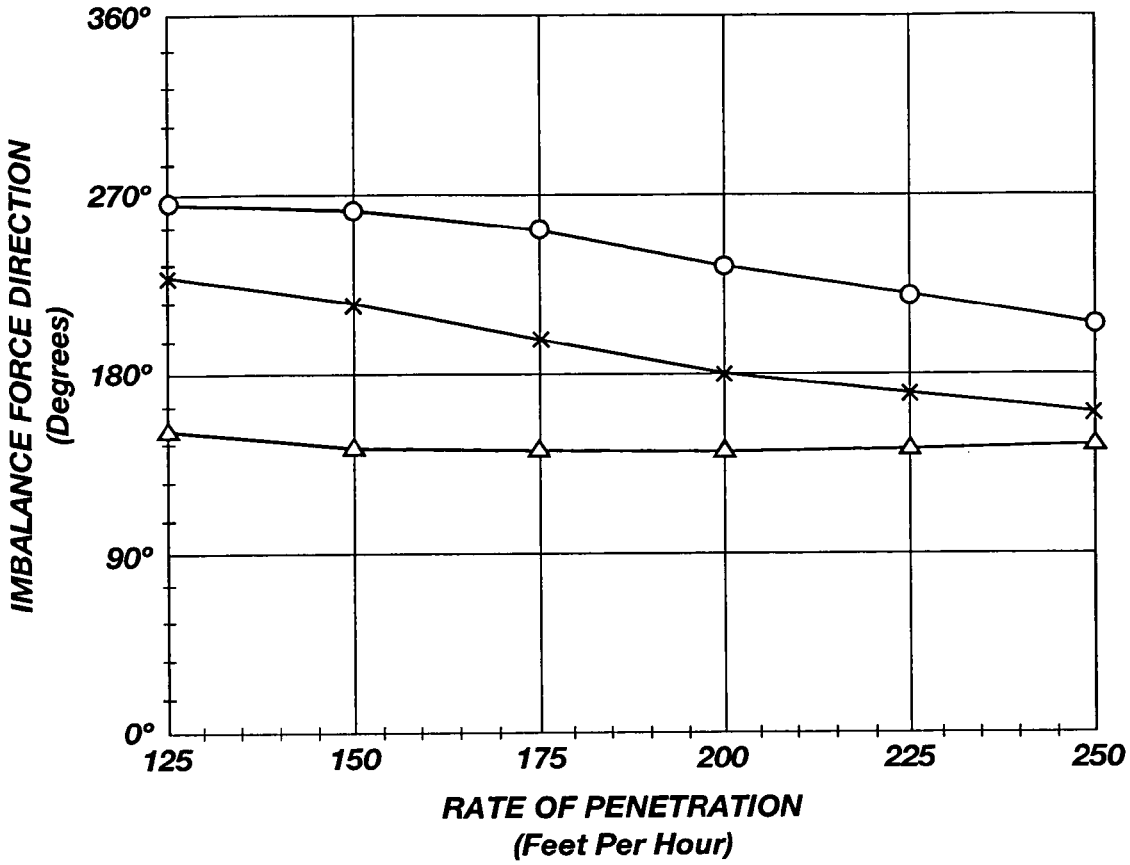
FIG. 6B is a graph of the calculated imbalance force magnitude for three different drill bits over a range of rates of penetration.

FIG. 6A is a graph illustrating the calculated imbalance force direction for three drill bits 10 over a range of rates of penetration extending from 125 feet per hour to 250 feet per hour. FIG. 6B is a graph illustrating the calculated imbalance force magnitude (expressed as a percentage of the weight on bit (WOB)) for the same three drill bits 10 over the same range of rates of penetration. By way of example and not limitation, the magnitude of an imbalance force of a drill bit 10 may be in a range extending from about zero to about twenty percent of the weight on bit (WOB), as illustrated in FIG. 6B. It may be necessary for the magnitude of the imbalance force of a drill bit 10 to exceed some threshold value before the imbalance force of the drill bit 10 affects the walk characteristics exhibited by the drill bit 10 in an appreciable manner. Furthermore, if the direction of the imbalance force causes a drill bit 10 to walk to the right or to the left, increasing the magnitude of the imbalance force may cause the rate at which the drill bit 10 walks to either the right or the left to also increase.

The magnitude and direction of imbalance forces for a plurality of drill bits, each having a design similar to the drill bit 10 shown in FIG. 1, have been calculated. Several observations have been made based on the calculated magnitude and direction of the imbalance forces for each of the drill bits and the observed walk characteristics exhibited by each of the drill bits. First, drill bits 10 having a calculated imbalance force vector 60 pointing in a radial direction from the center of the drill bit 10 towards a blade 20A, 20B, 20C, 20D may have a tendency to exhibit neutral walk. More particularly, drill bits 10 having a calculated imbalance force vector 60 pointing in a radial direction from the center of the drill bit 10 towards the center of the number one blade 20A (as shown in FIG. 5A) may have a tendency to exhibit neutral walk. Second, drill bits 10 having a calculated imbalance force vector 60 pointing in a radial direction from the center of the drill bit 10 towards the leading edge 21A of a blade 20A, 20B, 20C, 20D, or towards a junk slot 22 may have a tendency to walk to the left. More particularly, drill bits 10 having a calculated imbalance force vector 60 pointing in a radial direction from the center of the drill bit 10 towards the leading edge 21 of the number one blade 20A, or towards the junk slot 22 between the number one blade 20A and the blade 20D (as shown in FIG. 5B), may have a tendency to walk to the left. It is believed that drill bits 10 having a calculated imbalance force vector 60 pointing in a radial direction from the center of the drill bit 10 towards the trailing edge 21B of the number one blade 20A, or towards the junk slot 22 between the number one blade 20A and the blade 20D, may have a tendency to walk to the right.

As noted above, many factors and variables affect the magnitude and/or direction of the imbalance force of a drill bit 10. Such factors and variables include, but are not limited to, the size, location, and orientation of each of the individual cutters 28 on the face 18 of the drill bit 10, the rate of penetration, the rate of rotation of the drill bit 10, the weight on bit, etc. Some of these variables are related to the drill bit 10 itself (e.g., the size, location, and orientation of each of the individual cutters 28) and may be altered to configure the drill bit 10 to exhibit an imbalance force having a predetermined magnitude and direction for a given set of other variables having predefined values (e.g., the rate of penetration, the rate of rotation of the drill bit 10, and the weight on bit). Some of these variables that are related to the drill bit 10 are described in further detail below.

Figure 7:
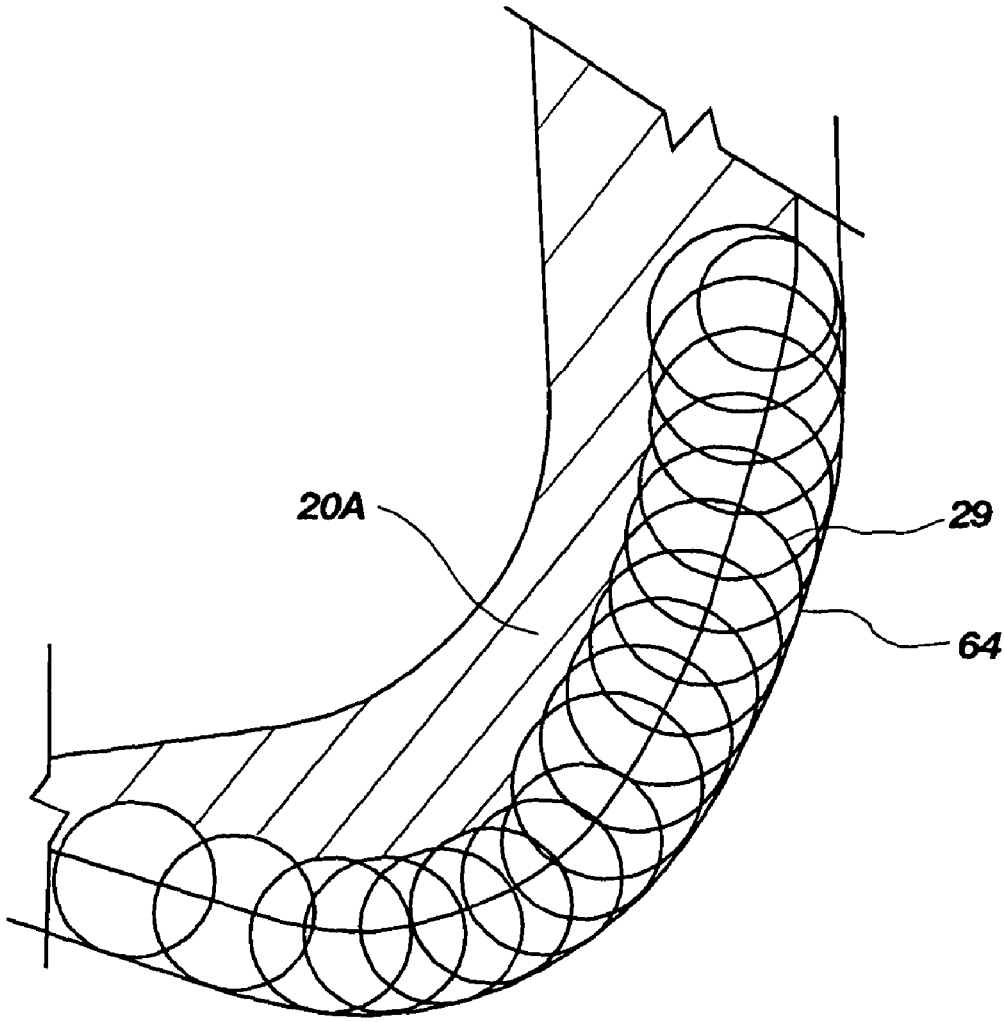
FIG. 7 illustrates the cutter profile of the drill bit shown in FIG. 2.

FIG. 7 illustrates what is known in the art as the "cutter profile" of the drill bit 10 shown in FIG. 2, and shows a cross-section of one blade, such as the number one blade 20A. Each of the overlapping circles represents the position that would be occupied on the blade 20A by a cutter 28 if each of the cutters 28 were rotated circumferentially about the longitudinal axis 40 of the drill bit 10 to a position on the number one blade 20A. As seen in FIG. 7, the cutting edges 29 of the cutters 28 may define a cutter profile, which is approximately represented by the line 64 in FIG. 7. Cutter profiles typically have a smooth curve, similar to that traced by the line 64 shown in FIG. 7.

The reactive forces acting on an individual cutter 28 by the surrounding subterranean formation being drilled may be altered by moving the individual cutter 28 out of profile. In other words, the location of one or more cutters 28 may be moved with respect to the cutter profile 64, thereby altering the overall imbalance force acting on the drill bit 10. As a result, the overall imbalance force acting on the drill bit 10 may be selectively adjusted by selectively moving the location of one or more cutters 28 with respect to the cutter profile 64. For example, one or more cutters 28 may be mounted deeper within a pocket 30 (FIG. 2), such that the cutting edge 29 of the cutter 28 exhibits a reduced exposure and does not extend radially outward to a point along the cutter profile 64. As another example, one or more cutters 28 may be mounted shallower within a cutter pocket 30, such that the cutting edge 29 of the cutter 28 exhibits an increased exposure and extends radially outward beyond the cutter profile 64.

Figure 8A:
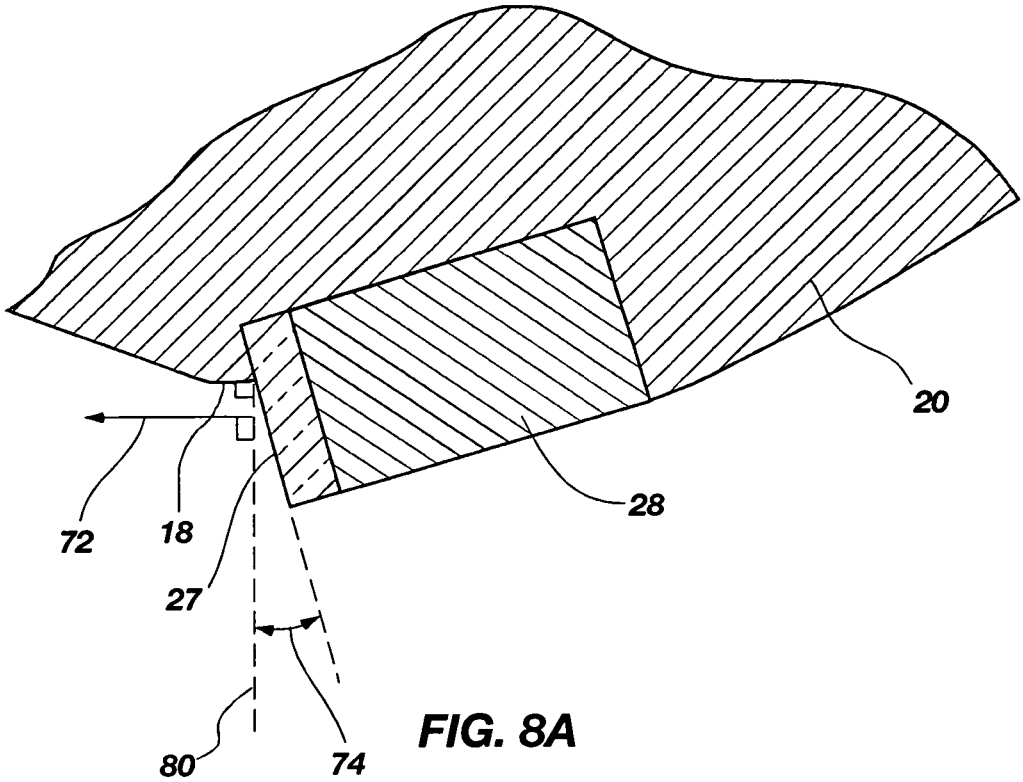
FIG. 8A illustrates the back rake angle of a cutting element on the face of the drill bit shown in FIG. 2.

The reactive forces acting on an individual cutter 28 by the surrounding subterranean formation being drilled may also be altered by, for example, adjusting the back rake angle or the side rake angle of the cutter 28. FIG. 8A illustrates what is referred to herein as the back rake angle 74 of a cutter 28, and FIG. 8B illustrates what is referred to herein as the side rake angle 76A, 76B of a cutter 28.

FIG. 8A is a cross sectional view of a cutter 28 positioned on a blade 20 of the drill bit 10 (FIG. 2). The cutting direction is represented by the directional arrow 72. The cutter 28 may be mounted on the blade 20 in an orientation such that the cutting face 27 of the cutter 28 is oriented at a back rake angle 74 with respect to a line 80. The line 80 may be defined as a line that extends (in the plane of FIG. 8A) radially outward from the face 18 of the drill bit 10 in a direction substantially perpendicular thereto at that location. Additionally or alternatively, the line 80 may be defined as a line that extends (in the plane of FIG. 8A) radially outward from the face 18 of the drill bit 10 in a direction substantially perpendicular to the cutting direction 72. The back rake angle 74 may be measured relative to the line 80, positive angles being measured in the counter-clockwise direction, negative angles being measured in the clockwise direction.

The cutter 28 is shown in FIG. 8A having a negative back rake angle of approximately 20°, thus exhibiting a "back rake." In other implementations, the cutter 28 may have a positive back rake angle. In such a configuration, the cutter 28 may be said to have a "forward rake." By way of example and not limitation, each cutter 28 on the face 18 of the drill bit 10 shown in FIG. 2 may, conventionally, have a back rake angle in a range extending from about −5° to about −30°.

Figure 8B:
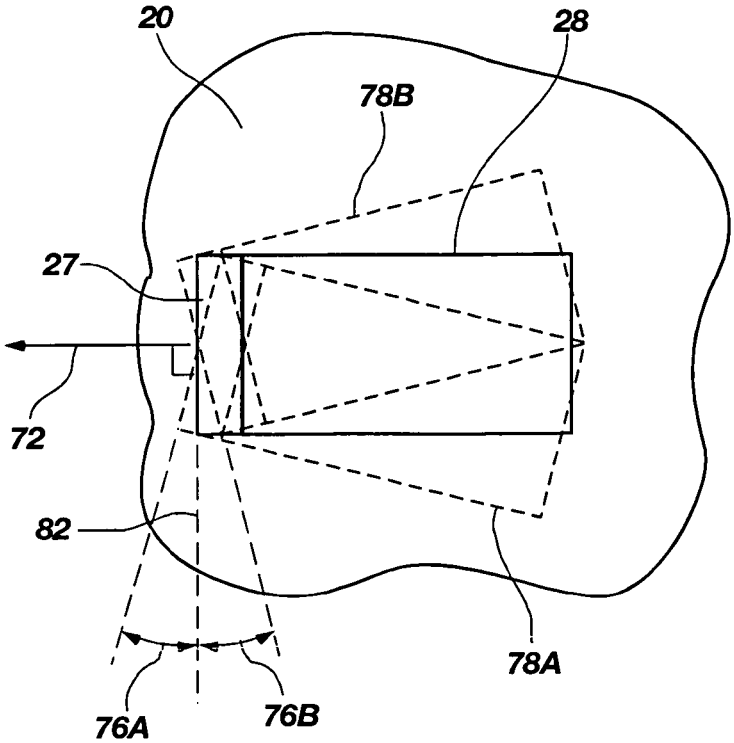
FIG. 8B illustrates the side rake angle of a cutting element on the face of the drill bit shown in FIG. 2.

FIG. 8B is an enlarged partial side view of a cutter 28 mounted on a blade 20 at the face 18 of the drill bit 10 shown in FIG. 2. The cutting direction is represented by the directional arrow 72. The cutter 28 may be mounted on the blade 20 in an orientation such that the cutting face 27 of the cutter 28 is oriented substantially perpendicular to the cutting direction 72. In such a configuration, the cutter 28 does not exhibit a side rake angle. The side rake angle of the cutter 28 may be defined as the angle between a line 82, which is oriented substantially perpendicular to the cutting direction 72, and the cutting face 29 of the cutter 28 (in the plane of the FIG. 8B), positive angles being measured in the counter-clockwise direction, negative angles being measured in the clockwise direction. In additional embodiments, the cutter 28 may be mounted in the orientation represented by the dashed line 78A. In this configuration, the cutter 28 may have a negative side rake angle 76A. Furthermore, the cutter 28 may be mounted in the orientation represented by the dashed line 78B. In this configuration, the cutter 28 may have a positive side rake angle 76B. By way of example and not limitation, each cutter 28 on the face 18 of the drill bit 10 shown in FIG. 2 may have a side rake angle in a range extending from about −30° to about 30°.

By way of example and not limitation, a drill bit 10 may be configured to exhibit a selected, predetermined imbalance force vector 60 by selectively altering or configuring the back rake angle 74 and/or the side rake angle 76A, 76B of one or more cutters 28 of the drill bit 10. By altering the back rake angle 74 and/or the side rake angle 76A, 76B of one or more cutters 28 of the drill bit 10, the reactive forces acting on that individual cutter 28 by the surrounding subterranean formation being drilled may be altered, thereby altering the overall imbalance force acting on the drill bit 10.

As yet another example, a drill bit 10 may be configured to exhibit a selected, predetermined imbalance force vector 60 by selectively altering or configuring the size or shape of one or more cutters 28 of the drill bit 10.

In addition to altering the size, shape, location, and orientation of one or more cutters 28 of the drill bit 10, the drill bit 10 may be configured to exhibit a selected, predetermined imbalance force vector 60 by selectively altering or configuring other elements or features of the drill bit 10 without limitation. Referring again to FIG. 2, one or more gage pads 34 may be selectively altered or configured (e.g., surface area, shape, location, presence or absence of cutters such as "gage trimmers" or surface set diamonds thereon, presence or absence of wear elements such as hardfacing, WC "bricks," surface roughness, hardness, etc.) such that the drill bit 10 exhibits a selected, predetermined imbalance force. Furthermore, the mass of the bit body 12 may be selectively altered within a selected, predetermined region of the bit body 12, such that the center of mass of the drill bit 10 is not disposed along the longitudinal axis 40 of the drill bit 10. This also may affect the imbalance force of the drill bit 10 and may be selectively configured to impart a desired imbalance force to the drill bit 10 during drilling.

The methods described herein may enable the fabrication of drill bits having predictable walk characteristics. Such drill bits may be fabricated and configured to walk to the right, walk to the left, or to exhibit neutral walk. As a result, drill bits may be configured to walk in a predetermined manner, and such drill bits may be used in directional drilling applications. Furthermore, drill bits may be configured to exhibit neutral walk, and such drill bits may be used to facilitate direction control and drill bit stability. For example, selectively configuring a drill bit to exhibit neutral walk characteristics may minimize or prevent wobble of the drill bit during a drilling operation, thereby resulting in better control of well bore hole dimensions and minimizing damage to the drill bit and the cutters thereon due to bit wobble within the well bore hole. Furthermore, the methods described herein may facilitate drill bit stability by providing drill bits that exhibit a relatively stable weight on bit-to-torque ratio as the weight on bit is steadily increased or decreased. Stated another way, as the weight on bit is increased in a substantially continuous or smooth manner, the torque may also increase in a substantially continuous or smooth manner without rapid increases or decreases.

Furthermore, a drill bit may have a tendency to walk in a particular direction with respect to a fault in the subterranean earth formation. If such walk is undesired, a drill bit may be configured to exhibit predicted, desirable walk characteristics using the methods described herein to counteract the walk tendency of the bit caused by the fault. For example, the drill bit may be configured to walk in a substantially opposite direction relative to the direction in which the drill bit tends to walk due to the fault in the formation.

Moreover, the methods described herein also may be used to predict the tendency of a drill bit to build or drop in a substantially similar manner as that described herein for predicting the tendency of a drill bit to walk to the right or to the left, thereby enabling the fabrication of drill bits having predictable build/drop characteristics.

Figure 9:
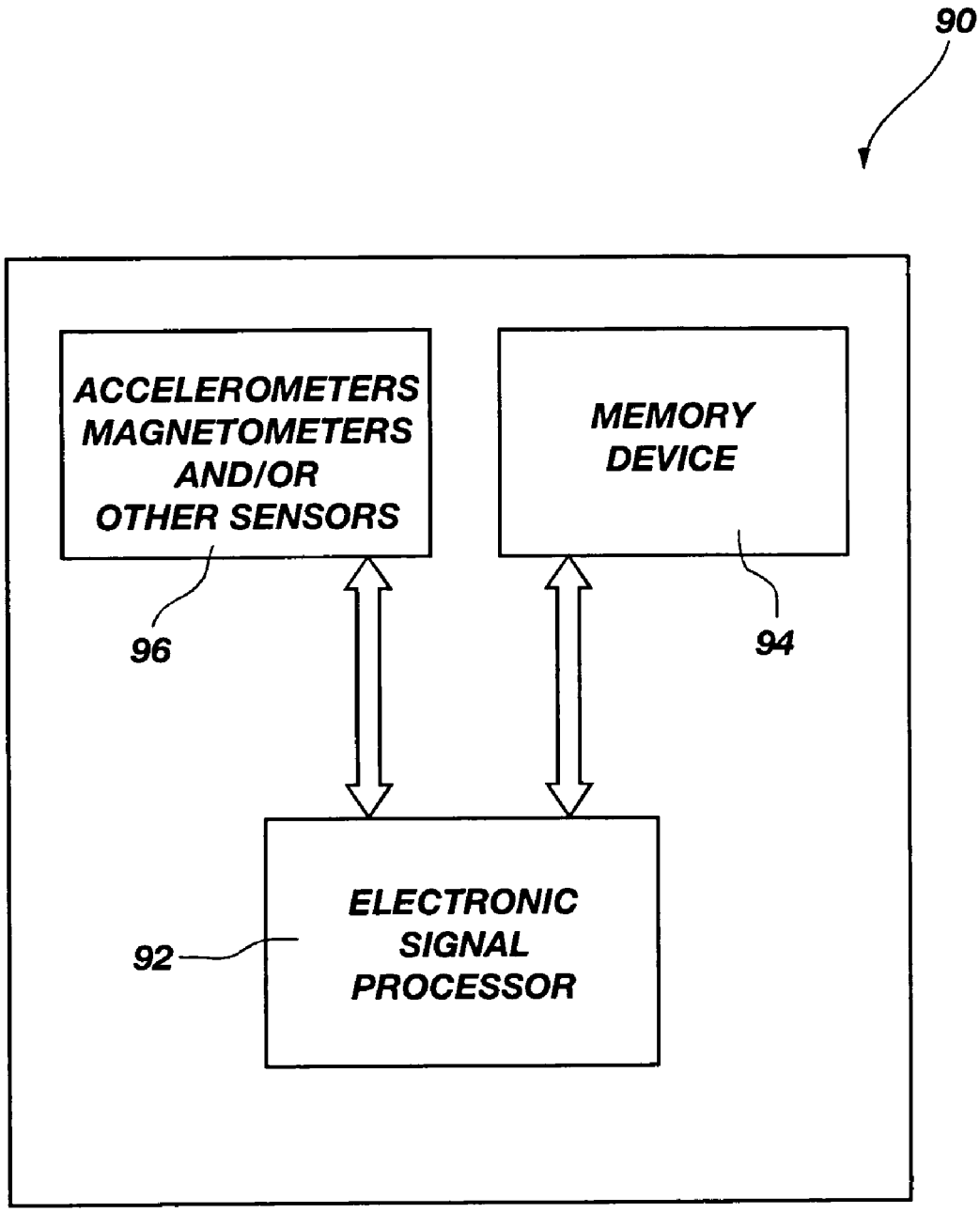
FIG. 9 is a schematic diagram of an electronic device that embodies teachings of the present invention and may be used to collect data relating to imbalance forces of a drill bit and walk characteristics exhibited by a drill bit for incorporation into a database.

FIG. 9 is a schematic diagram of an exemplary electronic device 90 that may be used to collect data from a drill bit 10 relating to the imbalance force of the drill bit 10 and the walk characteristics exhibited by the drill bit 10. The electronic device 90 may include at least one electronic signal processor 92, at least one memory device 94, and at least one input device 96. Optionally, the electronic device 90 may include an output device (not shown) configured to allow communication of data collected by the electronic device 90 to another device (e.g., a computer, personal digital assistant (PDA), graphical display device, printer, etc.). By way of example and not limitation, the at least one input device 96 may include an accelerometer, a magnetometer, or any other sensor device. Furthermore, the at least one input device 96 may include a plurality of input devices, and may include a combination of accelerometers, magnetometers, and other sensor devices. Furthermore, the electronic device 90 may be configured in any manner described in U.S. patent application Ser. No. 11/146,934, which was filed Jun. 7, 2005 and entitled "Method and Apparatus for Collecting Drill Bit Performance Data," the disclosure of which has been previously incorporated herein by reference in its entirety. In this configuration, the electronic device 90 may be incorporated into a drill bit 10, a shank attached to a drill bit 10, or any other component of a bottom hole assembly (BHA) or drilling string, and may be configured to collect data relating to imbalance force vectors of the drill bit 10 and the walk characteristics exhibited by the drill bit 10 in real time during a drilling operation for subsequent incorporation into a database as previously described herein.

Figure 10:
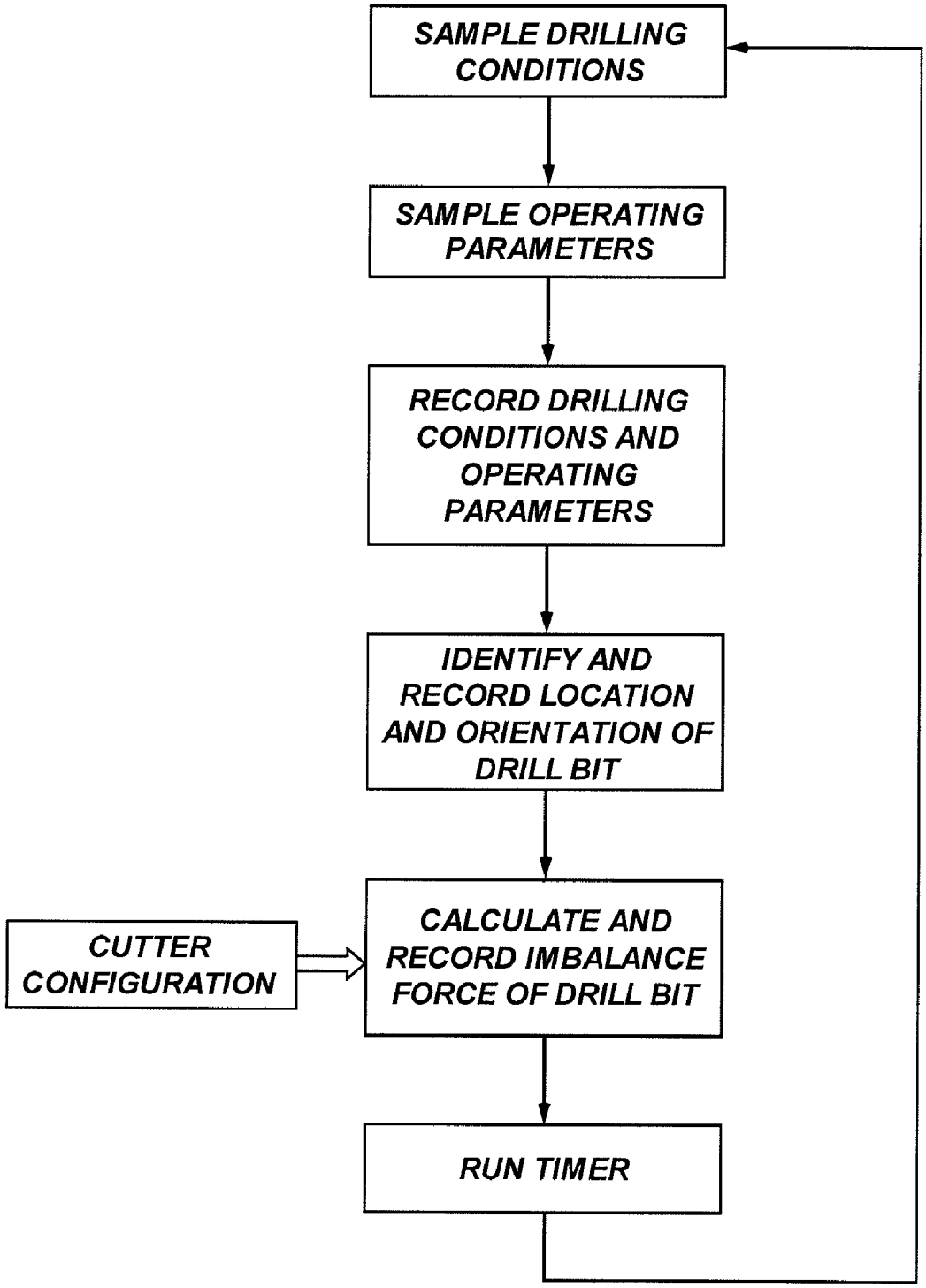
FIG. 10 is a flow chart illustrating a sequence of operations that may be performed by the electronic device shown in FIG. 9.

By way of example and not limitation, the electronic device 90 may be configured under control of a program to perform at least the sequence of operations illustrated in the flow chart shown in FIG. 10. As shown therein, the electronic device 90 may be configured to sample drilling conditions (e.g., the strength of the subterranean formation being drilled) and to sample operating parameters (e.g., weight on bit (WOB), rate of penetration (ROP), etc.) using the at least one input device 96 of the electronic device 90, and to record the sampled drilling conditions and operating parameters in the memory of the at least one memory device 94 of the electronic device 90. Additionally, if one or more of the drilling conditions and/or the operating parameters are known or estimated prior to drilling the subterranean earth formation, these drilling conditions and/or the operating parameters may be preprogrammed into the electronic device 90 as fixed variables, or as functions at least partially defined by other variables (drilling conditions and/or operating parameters).

Optionally, if the at least one input device 96 includes devices capable of determining the location and/or orientation of the drill bit 10, the electronic device 90 may be configured under control of the program to additionally determine the location and orientation of the drill bit 10 using the at least one input device 96 and to record the location and orientation of the drill bit 10 in the at least one memory device 94 of the electronic device 90. Furthermore, the electronic device 90 may be configured to determine the walk characteristics of the drill bit 10 by comparing the identified location and orientation of the drill bit 10 to previously recorded locations and orientations of the drill bit 10. The walk characteristics of the drill bit 10 then may also be recorded in the memory of the at least one memory device 94 of the electronic device 90.

Additionally, if the configuration of the cutters 28 (i.e., size, shape, location, and orientation) on the face of the drill bit 10 has been predetermined (using, for example, a coordinate measuring machine (CMM) as previously described herein), the configuration of the cutters 28 may be preprogrammed into the memory of the at least one memory device 94 of the electronic device 90. In such a configuration, the electronic device 90 may be configured under control of the program to additionally calculate a total imbalance force of the drill bit 10 using the cutter configuration, the drilling conditions, and the operating parameters, and to record the total imbalance force of the drill bit 10 using the at least one input device 96 and to record the location and orientation of the drill bit 10 in the at least one memory device 94. By way of example and not limitation, the electronic device 90 may be configured to calculate the total imbalance force of the drill bit 10 using the methods described in U.S. Pat. No. 4,815,342 to Brett et al.

After performing the above described sequence of operations, the electronic device 90 may be configured to run a timer for a predetermined amount of time before repeating the sequence of operations, as shown in the flow chart of FIG. 10. In this manner, the electronic device 90 may be used to collect and record data relating to the imbalance force of the drill bit 10 and the walk characteristics exhibited by the drill bit 10 during a drilling operation performed using the drill bit 10. The electronic device 90 may subsequently be recovered from the drill bit 10 (or the shank, bottom hole assembly, drill string, etc.) after the drill bit 10 has been removed from the well bore, and the data collected by the electronic device 90 then may be extracted from the electronic device 90 and incorporated into a database as previously described herein. Alternatively, the electronic device 90 may be configured to communicate with electronic equipment such as a computer system at the surface of the earth formation being drilled using the drill bit 10 continuously, or at periodic intervals, during the drilling operation to allow for the data collected thereby to be incorporated in real time into a database. Such communication may be effected by way of conductive wires or cables extending between the electronic device 90 and the surface of the formation, using wireless technology (e.g., electromagnetic radiation), or by any other means known in the art for transmitting information from within a well bore hole to the surface of the earth formation being drilled.

Figure 11:
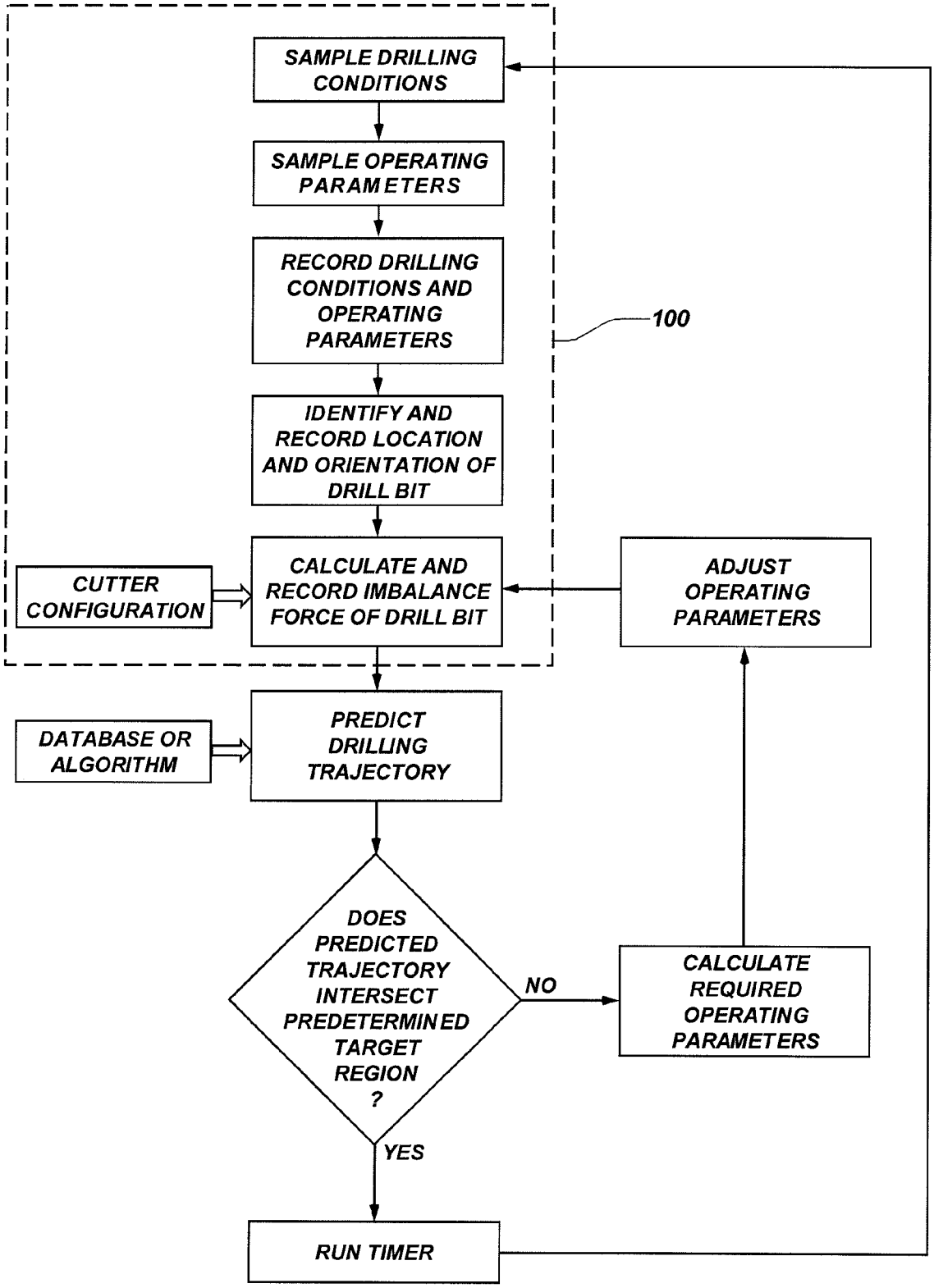
FIG. 11 is another flow chart illustrating another sequence of operations that may be performed by the electronic device shown in FIG. 9.

In an additional embodiment, the electronic device 90 may include a closed-loop system and may be configured to perform the sequence of operations illustrated in the flow chart shown in FIG. 11. As shown in the portion of the flow chart enclosed by the dashed line 100 in FIG. 11, the electronic device 90 may be configured under control of a program to perform substantially the same sequence of operations previously described in relation to FIG. 10. As shown in FIG. 11, however, the electronic device 90 may further be configured under control of a program to predict a drilling trajectory of the drill bit 10 through the subterranean formation being drilled.

For example, a previously constructed database correlating imbalance forces and walk characteristics of drill bits, or a mathematical algorithm derived from such a database that is capable of predicting the walk characteristics of a drill bit 10 based on a calculated imbalance force, may be preprogrammed into the at least one memory device 94 of the electronic device 90 (FIG. 9). Furthermore, the coordinates of a predetermined target region within the formation to which it is desired to drill using the drill bit 10 may also be preprogrammed into the at least one memory device 94 of the electronic device 90 (FIG. 9). After predicting the drilling trajectory of the drill bit 10 through the subterranean formation, the electronic device 90 may be configured to determine whether the predicted trajectory will intersect the predetermined target region within the formation.

If the predicted trajectory will not intersect the predetermined target region, the electronic device 90 may be configured under control of a program to calculate required operating parameters that will cause the walk characteristics exhibited by the drill bit 10 to change in such a way as to cause the predicted drilling trajectory of the drill bit 10 to intersect the predetermined target region within the formation. One or more of the operating parameters may then be adjusted so as to cause the predicted drilling trajectory of the drill bit 10 to intersect the predetermined target region within the formation. By way of example and not limitation, the electronic device 90 may include one or more outputs configured to automatically adjust one or more of the operating parameters. In addition, or as an alternative, the electronic device 90 may include one or more outputs configured to communicate data relating to one or more operating parameters to the surface of the formation being drilled to allow one or more operating parameters to be manually adjusted by personnel at the surface of the earth formation.

If the trajectory of the drill bit 10 predicted by the electronic device 90 will intersect the predetermined target region within the earth formation, the electronic device 90 may be configured to run a timer for a predetermined amount of time prior to repeating the above described sequence of operations.

In this manner, the electronic device 90 may be used to collect data relating to imbalance forces of a drill bit 10 and walk characteristics exhibited by the drill bit 10, and optionally, to predict the trajectory of the drill bit through a subterranean earth formation using such data and to determine whether the predicted trajectory of the drill bit 10 will intersect a predetermined target region within the formation, thereby facilitating directional drilling and/or deviation control.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors. Further, the invention has utility in drill bits and core bits having different and various bit profiles as well as cutter types.

What is claimed is:

1. A method of predicting the walk characteristics of a rotary drill bit for drilling at least one subterranean formation, the method comprising:

providing a rotary drill bit comprising a plurality of cutting elements fixedly mounted on a face thereof;

measuring locations and orientations of at least some cutting elements of the plurality of cutting elements on the face of the rotary drill bit;

calculating a magnitude and direction of an imbalance force of the rotary drill bit using at least some measurements obtained by measuring the locations and orientations of the at least some cutting elements;

drilling a wellbore with at least one other rotary drill bit having a calculated imbalance force and observing walk characteristics of the at least one other rotary drill bit while drilling the wellbore;

comparing the calculated magnitude and direction of the imbalance force of the rotary drill bit to the magnitude and direction of an imbalance force of the at least one other rotary drill bit; and predicting the walk characteristics of the rotary drill bit using the magnitude and direction of the imbalance force of the rotary drill bit, the magnitude and direction of the imbalance force of the at least one other rotary drill bit, and the observed walk characteristics of the at least one other rotary drill bit.

2. The method of claim 1, wherein providing a rotary drill bit comprises providing a rotary drill bit comprising a plurality of cutting elements disposed in a substantially circumferentially balanced distribution on the face of the drill bit.

3. The method of claim 1, wherein measuring the locations and orientations of the at least some cutting elements comprises using a coordinate measurement machine.

4. The method of claim 1, wherein measuring the locations and orientations of the at least some cutting elements comprises measuring each cutting element of the plurality of cutting elements.

5. The method of claim 1, wherein measuring the locations and orientations of the at least some cutting elements comprises measuring a longitudinal position relative to a longitudinal axis of the drill bit, a radial position relative to the longitudinal axis of the drill bit, a back rake angle, and a side rake angle of each of the at least some cutting elements of the plurality of cutting elements on the face of the drill bit.

6. The method of claim 1, wherein calculating the magnitude and direction of an imbalance force of the drill bit comprises calculating the magnitude and direction of an imbalance force of the drill bit during at least one selected rate of penetration.

7. The method of claim 6, wherein calculating the magnitude and direction of an imbalance force of the rotary drill bit during at least one selected rate of penetration comprises calculating the magnitude and direction of an imbalance force over a plurality of rates of penetration.

8. The method of claim 1, wherein comparing the calculated magnitude and direction of the imbalance force comprises comparing the calculated magnitude and direction of the imbalance force of the rotary drill bit to the magnitude and direction of an imbalance force of a plurality of other rotary drill bits having calculated imbalance forces and known walk characteristics.

9. The method of claim 1, further comprising calculating a drill bit trajectory through at least one selected subterranean earth formation to a predetermined target region using the predicted walk characteristics of the rotary drill bit.

10. The method of claim 1, wherein comparing the calculated magnitude and direction of the imbalance force comprises referencing a database or catalogue containing the magnitude and the direction of a calculated imbalance force and the observed walk characteristics of each of a plurality of other rotary drill bits.

11. The method of claim 10, wherein comparing further comprises using a computer system to perform an algorithm configured to electronically reference a database and compare the calculated magnitude and direction of the imbalance force of the rotary drill bit to the magnitude and direction of a calculated imbalance force of each of a plurality of other rotary drill bits to predict the walk characteristics of the rotary drill bit.

12. A method of designing a rotary drill bit for drilling at least one subterranean formation to cause the rotary drill bit to exhibit at least one predicted walk characteristic, the method comprising:

fabricating a plurality of rotary drill bits, each drill bit comprising a plurality of cutting elements fixedly mounted on a face thereof;

calculating the magnitude and direction of an imbalance force of each rotary drill bit of the plurality;

observing walk characteristics of each rotary drill bit of the plurality while drilling at least one subterranean formation using each rotary drill bit of the plurality;

constructing a database including the magnitude and direction of the calculated imbalance force and observed walk characteristics of each of the plurality of rotary drill bits;

selecting at least one desired walk characteristic to be exhibited by a rotary drill bit to be fabricated to include a plurality of cutting elements on each of a plurality of longitudinally extending blades disposed over a face of the rotary drill bit, the plurality of blades defining junk slots therebetween;

referencing the database to determine locations and orientations of at least some cutting elements of the plurality to cause the rotary drill bit to generate a calculated magnitude and direction of an imbalance force to cause the rotary drill bit to exhibit the at least one desired walk characteristic; and fabricating the drill bit in accordance with the determined locations and orientations of the at least some cutting elements of the plurality.

13. The method of claim 12, wherein calculating the magnitude and direction of an imbalance force of each rotary drill bit of the plurality comprises:

measuring locations and orientations of at least some cutting elements of the plurality of cutting elements on the face of each rotary drill bit of the plurality of rotary drill bits;

calculating the magnitude and direction of an imbalance force of each rotary drill bit of the plurality using the measured locations and orientations of the at least some cutting elements.

14. The method of claim 12, wherein calculating the magnitude and direction of an imbalance force comprises calculating the magnitude and direction of an imbalance force at each of a plurality of different rates of penetration, and wherein determining the walk characteristics of each rotary drill bit comprises determining the walk characteristics of each rotary drill bit of the plurality at each of the plurality of different rates of penetration.

15. The method of claim 12, wherein referencing the database comprises manually referencing the database.

16. The method of claim 12, wherein fabricating the rotary drill bit further comprises securing a plurality of cutting elements to a face of the rotary drill bit with at least some of the plurality of cutting elements disposed at the determined locations and orientations.

17. The method of claim 12, wherein configuring the rotary drill bit to exhibit an imbalance force having a predetermined magnitude and direction comprises configuring at least one of a size, a radial position, a longitudinal position, a back rake angle, and a side rake angle of at least one cutting element of the at least some cutting elements on the face of the rotary drill bit.

18. The method of claim 12, wherein referencing the database to determine locations and orientations of at least some cutting elements of the plurality to cause the rotary drill bit to generate a calculated magnitude and direction of an imbalance force to cause the rotary drill bit to exhibit the at least one desired walk characteristic comprises causing the rotary drill bit to generate a calculated imbalance force oriented in a predetermined direction relative to a blade of the plurality of longitudinally extending blades disposed over the face of the rotary drill bit.

19. The method of claim 12, wherein referencing the database to determine locations and orientations of at least some cutting elements of the plurality to cause the rotary drill bit to generate a calculated magnitude and direction of an imbalance force to cause the rotary drill bit to exhibit the at least one desired walk characteristic comprises causing the rotary drill bit to exhibit left walk by causing the rotary drill bit to generate an imbalance force having a direction extending toward a blade of the plurality of longitudinally extending blades disposed over the face of the rotary drill bit.

20. The method of claim 12, wherein referencing the database to determine locations and orientations of at least some cutting elements of the plurality to cause the rotary drill bit to generate a calculated magnitude and direction of an imbalance force to cause the rotary drill bit to exhibit the at least one desired walk characteristic comprises causing the rotary drill bit to exhibit neutral walk by causing the drill bit to generate an imbalance force having a direction oriented toward a junk slot defined between two blades of the plurality of longitudinally extending blades disposed over the face of the drill bit.

21. A method of drilling at least one subterranean formation, the method comprising:

observing walk characteristics of each rotary drill bit of a plurality of rotary drill bits while drilling at least one subterranean formation using each rotary drill bit of the plurality of rotary drill bits;

calculating a magnitude and direction of an imbalance force of each rotary drill bit of the plurality of rotary drill bits;

providing another rotary drill bit having a bit body including a plurality of longitudinally extending blades defining junk slots therebetween, each blade of the plurality of blades having a plurality of cutting elements mounted thereon;

configuring the another rotary drill bit to exhibit an imbalance force oriented in a predetermined direction relative to a blade of the plurality of blades to impart at least one desired walk characteristic to the another rotary drill bit, the predetermined direction selected with reference to the observed walk characteristics of the plurality of rotary drill bits and the direction of the imbalance forces of the plurality of rotary drill bits;

defining a drill bit trajectory through a subterranean earth formation at least in part in consideration of predicted walk characteristics of the another rotary drill bit; and drilling a bore hole through the at least one subterranean formation using the another rotary drill bit along the defined drill bit trajectory.

22. The method of claim 21, wherein providing another rotary drill bit comprises fabricating the another rotary drill bit.

23. The method of claim 22, wherein fabricating the another drill bit further comprises securing each cutting element to a blade of the another rotary drill bit at locations and orientations calculated to cause the another rotary drill bit to generate the imbalance force to cause the another rotary drill bit to exhibit the at least one desired walk characteristic.

24. The method of claim 22, wherein configuring the another rotary drill bit to exhibit an imbalance force comprises selecting at least one of a size, a radial position, a longitudinal position, a back rake angle, and a side rake angle of at least one cutting element of the plurality of cutting elements.

25. The method of claim 22, wherein defining a drill bit trajectory comprises defining the drill bit trajectory prior to drilling a bore hole through the at least one subterranean formation.

26. The method of claim 22, wherein defining a drill bit trajectory comprises calculating the drill bit trajectory.

27. The method of claim 22, wherein defining a drill bit trajectory comprises defining the drill bit trajectory through at least one subterranean formation to a predetermined target region within the at least one subterranean formation.

* * * * *